US010227801B2

(12) United States Patent
Brown, III

(10) Patent No.: US 10,227,801 B2
(45) Date of Patent: Mar. 12, 2019

(54) DISPLAY CASE FOR COLLECTABLES

(71) Applicant: James Thomas Brown, III, Knoxville, TN (US)

(72) Inventor: James Thomas Brown, III, Knoxville, TN (US)

( * ) Notice: Subject to any disclaimer, the term of this patent is extended or adjusted under 35 U.S.C. 154(b) by 74 days.

(21) Appl. No.: 14/884,157

(22) Filed: Oct. 15, 2015

(65) Prior Publication Data

US 2016/0029814 A1 Feb. 4, 2016

Related U.S. Application Data

(63) Continuation-in-part of application No. 14/625,620, filed on Feb. 18, 2015, now Pat. No. 9,907,417.

(60) Provisional application No. 61/941,608, filed on Feb. 19, 2014.

(51) Int. Cl.

| | |
|---|---|
| ***A47G 1/06*** | (2006.01) |
| ***E05C 19/00*** | (2006.01) |
| ***A47G 1/12*** | (2006.01) |

(52) U.S. Cl.

CPC ..... *E05C 19/00* (2013.01); *A47G 1/12* (2013.01); *A47G 2001/0672* (2013.01)

(58) Field of Classification Search

CPC ..... A47F 2003/008; A47F 2007/0092; A47G 1/12

USPC ..... 312/114, 138.1

See application file for complete search history.

(56) References Cited

U.S. PATENT DOCUMENTS

| | | | | |
|---|---|---|---|---|
| 1,953,357 | A * | 4/1934 | Leya | A47B 47/04 312/114 |
| 3,717,395 | A * | 2/1973 | Spielvogel | A47F 3/005 108/60 |
| 4,258,488 | A | 3/1981 | Schienbein | |
| 5,249,683 | A | 10/1993 | Baucom | |
| 5,277,949 | A | 1/1994 | Green | |
| 5,524,977 | A * | 6/1996 | Orawski | A47F 3/005 312/114 |
| 5,630,546 | A * | 5/1997 | Velch | B65D 5/4208 206/425 |
| 5,730,291 | A | 3/1998 | Smallwood | |
| 5,971,826 | A | 10/1999 | Delzompo et al. | |
| 6,070,721 | A | 6/2000 | Levitan | |
| 6,442,879 | B1 | 9/2002 | Callendar et al. | |

(Continued)

FOREIGN PATENT DOCUMENTS

| | | |
|---|---|---|
| WO | WO0057389 | 9/2000 |
| WO | WO2011028537 | 3/2011 |
| WO | WO2012142412 | 10/2012 |

OTHER PUBLICATIONS

Notification of Transmittal of the International Search Report and The Written Opinion of The International Searching Authority, or the Declaration, 16 pages, dated May 20, 2015.

*Primary Examiner* — Joanne Silbermann

(74) *Attorney, Agent, or Firm* — Knox Patents; Thomas A. Kulaga

(57) ABSTRACT

Apparatus for displaying packaged collectables in a supportive and protective case. A rear frame member is secured to a front frame member with a latch. The front frame member and rear frame member form a display case when latched together. In one embodiment the latch relies upon magnetic coupling between the front and rear frame members. The front and rear frame members have transparent panes or portions. The collectable is visible from the front, back, top and sides of the case.

19 Claims, 17 Drawing Sheets

(56) References Cited

U.S. PATENT DOCUMENTS

| | | | | |
|---|---|---|---|---|
| 6,554,132 | B2 | 4/2003 | Lau | |
| 7,069,682 | B2 | 7/2006 | Gatt et al. | |
| 7,437,846 | B2 * | 10/2008 | Franco | A47G 1/065 206/449 |
| 7,591,097 | B2 | 9/2009 | Alman | |
| 8,595,969 | B1 | 12/2013 | Wheelis et al. | |
| 2003/0226302 | A1 * | 12/2003 | Flodin | A47G 1/143 40/781 |
| 2006/0181180 | A1 * | 8/2006 | McCabe | A47F 3/001 312/114 |
| 2007/0087651 | A1 | 4/2007 | Ali | |
| 2008/0120883 | A1 | 5/2008 | Haase et al. | |
| 2009/0100732 | A1 | 4/2009 | Seidler | |
| 2009/0121109 | A1 | 5/2009 | Kinmont et al. | |
| 2011/0131855 | A1 | 6/2011 | Heeps | |
| 2012/0285060 | A1 | 11/2012 | Gross | |
| 2015/0230633 | A1 | 8/2015 | Brown | |

* cited by examiner

DISPLAY CASE FOR COLLECTABLES

CROSS-REFERENCE TO RELATED APPLICATIONS

This application is a continuation-in-part of application Ser. No. 14/625,620, filed Feb. 18, 2015, which claims the benefit of U.S. Provisional Application No. 61/941,608, filed Feb. 19, 2014.

STATEMENT REGARDING FEDERALLY SPONSORED RESEARCH OR DEVELOPMENT

Not Applicable

BACKGROUND

1. Field of Invention

This invention pertains to display cases for collectables. More particularly, this invention pertains to frames and cases that display items that remain in their original packaging.

2. Description of the Related Art

Frames are widely available in a wide assortment of shapes, sizes, styles, and colors for displaying pictures, paintings, drawings, and works of art. Picture frames, for example, are available and generally have a rectangular configuration with an open or transparent front through which the picture is visible and protected. Such frames are suited for displaying flat, planar objects, such as a painting or photograph. Many such picture frames allow viewing only from the front of the frame and are not intended to be picked up and handled so that the picture can be viewed from the back side.

Various frames and display devices are known. For example, United States Patent Application Number 2009/0100732, naming inventor Stewart Seidler, published on Apr. 23, 2009, and titled, "Magnetic display device," discloses a display case having external magnets for combining multiple frames into a modular display device album. U.S. Pat. Application Number 2012/0285060, naming inventor Raoul Gross, published on Nov. 15, 2012, and titled, "Picture frames," discloses picture frames with flexible borders that can be coupled together in a variety of configurations. Like the Seidler patent application, the Gross patent application discloses magnets to couple one picture frame to another.

United States Patent Application Number 2009/0121109, naming inventor Richard C. Kinmont, published May 14, 2009, and titled, "Display stand for action figure," discloses one method for displaying an action figure or collectable on a lighted, table-top stand. The collectable is removed from its packaging for display, which subjects the collectable to damage and soiling from handling.

United States Patent Application Number 2007/0087651, naming inventor Aneel Ali, published Apr. 19, 2007, and titled, "Action figure stands," also discloses a way to display action figures or collectables. The stand described in the Ali application has a support that attaches to the figure and to the stand, thereby securing the figure to the stand and making it more stable. As with the above application, the collectable is removed from its packaging for display, which subjects the collectable to damage and soiling from handling.

U.S. Pat. No. 4,258,488, issued to Schienbein on Mar. 31, 1981, and titled, "Phonograph record album display frame," discloses a frame with an opening that receives an album cover. The album cover is positioned inside the opening with the bottom of the album cover resting in a groove or between bosses in the bottom of the opening with the album cover tilted back and resting against an inside surface of the frame. The display frame allows only the front, exposed surface of the album cover to be viewed without removing the album cover from the display frame.

Another type of display device for a phonograph album is disclosed in U.S. Pat. No. 6,070,721, issued to Levitan on Jun. 6, 2000, and titled "Display case for phonograph album and record." The '721 patent discloses a shallow rectangular open topped base tray with a hinged transparent cover that latches in position. The tray includes a support post that secures the record outside the album cover such that a portion of the record is visible along with the album cover.

BRIEF SUMMARY

According to one embodiment of the present invention, a display case for collectables is provided. Collectables are objects that have value to collectors. Collectables include such items as action figures; movie, sports and game memorabilia; music albums; and posters. These collectables are often kept in their original merchandising packaging. It is desirable to display such collectables in a manner so as to avoid damaging the packaging.

The display case comprises a first frame member having at least three walls. A first wall and a second wall of the first frame member are adjacent and perpendicular to one another. The remaining walls each include an opening and a transparent pane proximate said opening. A second frame member has a first wall and a second wall adjacent and perpendicular to one another. The first wall of this second frame member includes a recess configured to engage the first wall of the first frame member. The recess of the first wall of the second frame member includes a transparent pane or portion. The second wall of the second frame member is configured as a base supporting the first and second frame members on a horizontal surface. At least one latch secures the first frame member to second frame member such that the first and second frame members are mated to form an enclosed volume that is visible from substantially all of the outer surface of the enclosure. Each one of the latches includes a magnet and a metal object that engages the magnet to latch the first frame member to the second frame member. Either the magnet or metal object is attached to the first frame member, while the other part is attached to the second frame member.

In one embodiment the display case includes a first edge, wherein the first edge is a distal edge of the second wall of the first frame member. The first edge is parallel to the first wall of the second frame member. The display case is configured to pivot on the first edge between the first position and a second position, wherein in the second position the first wall of the first frame member is disengaged from the first wall of the second frame member. In one embodiment the display case includes a second edge. The second edge is an edge of the first wall of the first frame member. The said second edge is not parallel to the second wall of the first frame member. The apparatus is configured to pivot on the second edge between the first position and a third position. In the third position the first wall of the first frame member is disengaged from the first wall of the second frame member.

In one embodiment each magnet is embedded in the second frame member. In one embodiment the first and second frame members are configured such that the closed case has the first walls of the first and second frame members superposed. In one embodiment the recess in the first wall of the second frame member is taller and wider than the first wall of the first frame member. In one embodiment none of the latches are located near the first edge. In one embodiment a back surface of the first wall of the second frame member includes a hanger configured to attach the second frame member to a wall.

In another embodiment of the present invention, a second display case for collectables is provided. A first frame member has a first wall and two lips. The first wall includes an opening and a transparent pane proximate the opening. The two lips are on opposite ends of the first wall. A second frame member has at least four walls. A first wall includes an opening. A second wall and a third wall each include an opening and a transparent pane proximate the opening. A fourth wall is configured as a base supporting the first and second frame members on a horizontal surface. At least one latch secures the first frame member to the second frame member such that: (a) the first frame member and said second frame member are in a first position forming the closed display case, such that the first wall of the first frame member is parallel and adjacent to said first wall of the second frame member, (b) substantially all of the inside volume is visible from substantially all of the closed case's outer surface that is above the fourth wall of the second frame member, and (c) the two lips are parallel with at least a portion of the second and third wall of the first frame member. Each latch includes a magnet and a metal object that engages the magnet to latch the first frame member to the second frame member, one of said magnet and said metal object attached to said first frame member, and an other one of said magnet and said metal object attached to said second frame member.

In one embodiment the display case includes a first edge, wherein the first edge is a lower outer edge of the first wall of the first frame member, and wherein the first edge is parallel and adjacent to the fourth wall of the second frame member. The apparatus is configured to pivot on the first edge between the first position and a second position. In the second position the first wall of the first frame is disengaged from the first wall of the second frame. In one embodiment the display case includes a second edge. The second edge is an edge of the first wall of the first frame member and adjacent one of the lips. The apparatus is configured to pivot on said second edge between said first position and a third position, wherein in said third position said first wall of said first frame is disengaged from said first wall of said second frame. In one embodiment a gap between the two lips is greater than a horizontal width of the first wall of the second frame member. In one embodiment the display case includes a fifth wall of the second frame member. The fifth wall includes an opening and a transparent pane proximate the opening. The fourth and fifth walls are not adjacent to each other and are both adjacent to the first wall of the second frame member. The height of the first frame member is less than the gap between the fourth and fifth walls of the second frame member. In one embodiment the lips are perpendicular to the first wall of the first frame member, and are configured to be graspable by a user when the apparatus is in the first position.

In another embodiment of the present invention, a display frame for collectables is provided. The display frame includes a front frame member and a rear frame member with the collectable sandwiched between a front pane and a rear pane secured by the front and rear frame members. For those collectables that have a blister on the front of the packaging, the blister extends through an opening in the front pane. In this way the collectable is supported and protected to prevent the packaging from becoming distorted and/or damaged while still allowing the collectable to be visible for display.

The front frame member includes a front surface and four side surfaces or sidewalls that extend rearward from the front surface. In the front surface is an opening. A front pane is positioned inside the front frame member proximate the opening in the front surface. A resilient material extends from a portion of the front pane opposite the front surface of the front frame member.

The rear frame member includes a rear surface and four side surfaces. In the rear surface is an opening. A rear pane is positioned proximate the front surface of the rear frame member proximate the opening in the rear surface. A resilient material extends from a portion of the rear pane opposite the rear surface of the rear frame member. In various embodiments a frame hanger is attached to the rear surface for hanging the display frame to a wall. In one such embodiment the rear surface of the rear frame member includes standoffs or spacers that space the rear surface and the back edge of the front frame member sidewalls away from the wall.

The rear frame member fits inside the front frame member with the rear surface of the rear frame member visible from the back of the front frame member. A latch mechanism secures the front frame member to the rear frame member. The latch mechanism includes a plurality of magnets that are attached to the inside surface of the front frame member and a material responsive to the magnets that is attached to the front surface of the rear frame member at positions corresponding to the magnet locations. In this way the front and rear frame members are secured or latched together. In another embodiment, the magnets are attached to the rear frame member and the material responsive to the magnets is attached to the rear surface of the front frame member at positions corresponding to the magnet locations.

The front frame member includes at least one outside notch that corresponds with at least one inside notch or edge in the rear frame member. The notches allow a user to separate the front frame member from the rear frame member by manipulating an edge of the rear frame member through the outside notch.

For collectables that are in blister-type packaging, the front pane includes a cutout or opening sized and configured to allow the blister to extend through the front pane. In another embodiment the front pane is non-planar and extends over the blister, thereby protecting the collectable. The planar portion of the collectable packaging is sandwiched between the front and rear panes. For collectables that are completely planar the collectable is entirely enclosed by the display frame, thereby protecting the collectable from fingerprints and other damage from handling when the collectable is viewed.

In another embodiment the display frame includes a front frame member and a rear frame member wherein the rear frame member is a planar sheet that fits inside said front frame member and rests on frame support ribs. The rear frame member and the front frame member latch together, securing the collectable therebetween. The latch mechanism includes a tab protruding from the rear frame member and a slot in a sidewall of the front frame member configured to receive the tab. In one embodiment the latch mechanism includes detents on the inside sidewall surface of the front frame member that engage the edge of the rear frame member, thereby securing the rear frame member to the front frame member. In another embodiment the latch mechanism includes a magnetic assembly that secures the rear frame member to the front frame member by magnetic attraction. A notch in the sidewall of the front frame member opposite the slot for the tab allows a user to apply pressure to the edge of the rear frame exposed by the notch, thereby unlatching the members by prying the rear frame member from the front frame member.

The rear frame member is offset inside the front frame member with spacers attached to the rear, outer surface of the rear frame member that extend beyond the rearmost portion of the front frame member. In this way the spacers support the rear frame member when the rear frame member is positioned on a flat surface, such as a table top. The collectable is then placed on the rear frame member and the front frame member is placed over the collectable and secured to the rear frame member by pushing the front frame member against the flat surface.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for displaying a collectable 108 is disclosed. The display frame is indicated generally as 100, with particular embodiments and variations shown in the figures and described below having an alphabetic suffix, for example, 100-A and 100-B.

Figure 1:
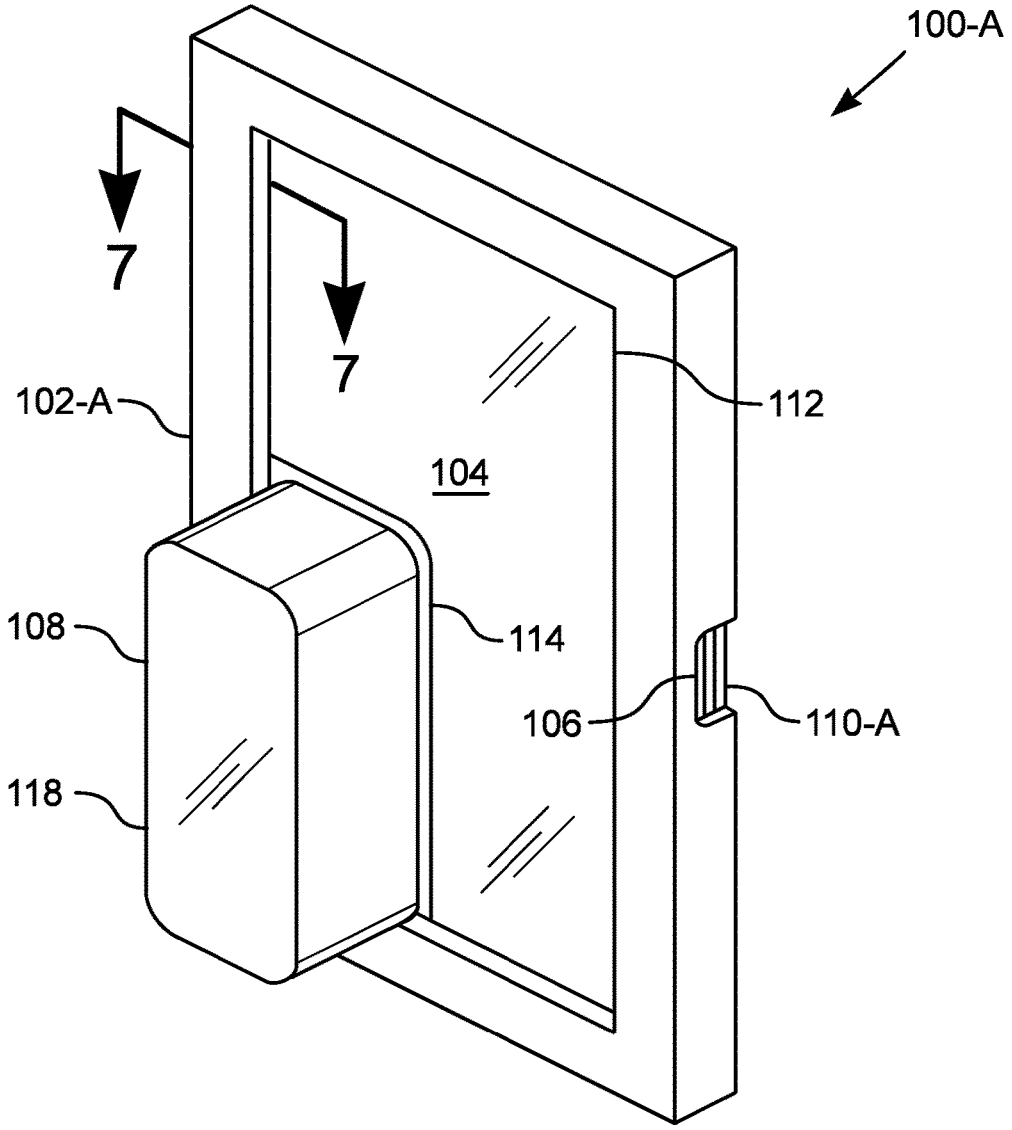
FIG. 1 is an isometric view of one embodiment of a display frame.
Figure 2:
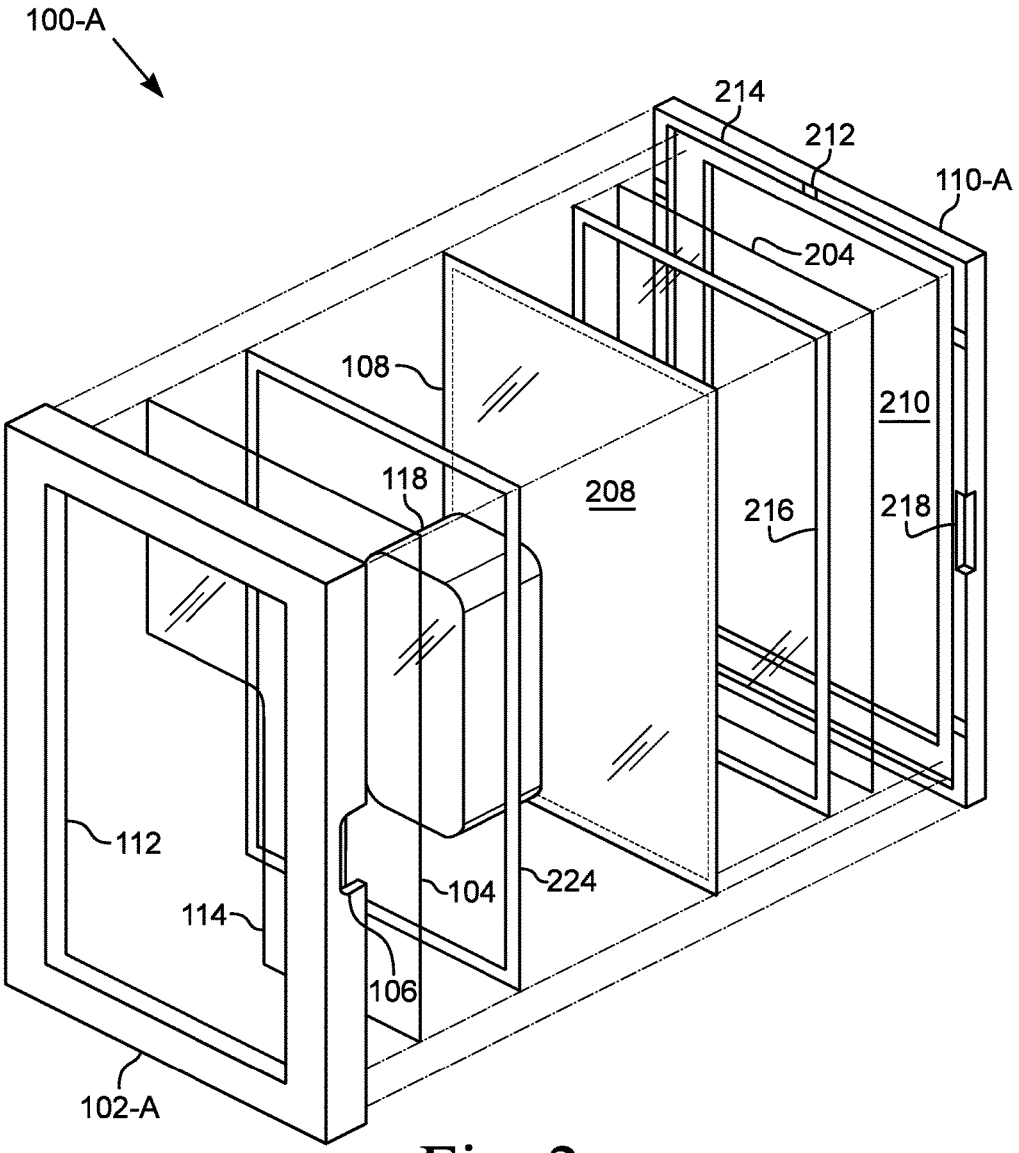
FIG. 2 is an exploded diagram showing the display frame of FIG. 1.

FIG. 1 illustrates an isometric view of one embodiment of a display frame 100-A. FIG. 2 illustrates an exploded diagram showing the display frame 100-A of FIG. 1. The collectable 108 in the illustrated embodiment has a blister 118 and a planar portion 208. The blister 118 is located at the lower left corner of the collectable 108. Other collectables 108 have various sized blisters 118 located at various positions on the planar portion 208. Some collectables 108, such as albums and posters, have only a planar portion 208 with no blister 118.

The display frame 100-A includes a front frame member 102-A and a rear frame member 110-A. The front frame member 102-A is a rectangular structure that includes a front pane 104. The rear frame member 110-A is a rectangular structure that includes a rear pane 204. Between the front and rear panes 104, 204 is the collectable 108.

The front frame member includes an outside notch 106 that aligns with an inside notch 218 on the rear frame member. The pair of notches 106, 218 allow the front frame member 102-A to be easily separated from the rear frame member 110-A. By positioning the notches 106, 218 on the side the front frame member can be easily removed without interference with or scraping the blister 118.

The front pane 104 fits inside the front frame member 102-A. The front pane 104 is a clear or transparent sheet that allows the front of the collectable 108 to be visible from the front of the display frame 100-A. The front pane 104, in the illustrated embodiment of the display frame 100-A, includes a front opening 114 through which the blister 118 fits. Because of the variety of collectables 108 and the varied positioning of blisters 118, the opening 114 in the front pane 104 varies to correspond with the position of the blister 118 on the collectable 108 desired to be displayed by the frame 100-A. The edges of the front opening 114 extend to the sides of the blister 118, but do not contact the sides of the blister 118. The front pane 104 overlaps the portion of the blister 118 that is attached to the planar portion 208 of the packaging of the collectable 108. In this way the front pane 104 provides support and protection of the attachment of the blister 118 to the planar portion 208, thereby minimizing the risk of the blister 118 being pulled off or separating from the planar portion 208. In another embodiment the front pane 104 is non-planar, but has a shape that conforms to the collectable 108. In such an embodiment a portion of the front pane 104 extends away from the front frame member 102-A such that the collectable 108 is enclosed by the front pane 104.

The rear pane 204 is a clear or transparent sheet that fits inside the rear frame member 110-A. The rear pane 204 is sandwiched between a resilient material 216 and the rear frame member 110-A. The rear frame member 110-A includes a rear opening 210 that allows the rear of the collectable 108 to be visible from the rear of the display frame 100-A. The front periphery of the rear frame member 110-A includes a plurality of spaced metal objects 212 that are responsive to a magnetic field. The intervening space between the spaced metal objects 212 includes a resilient material 214.

Figure 3:
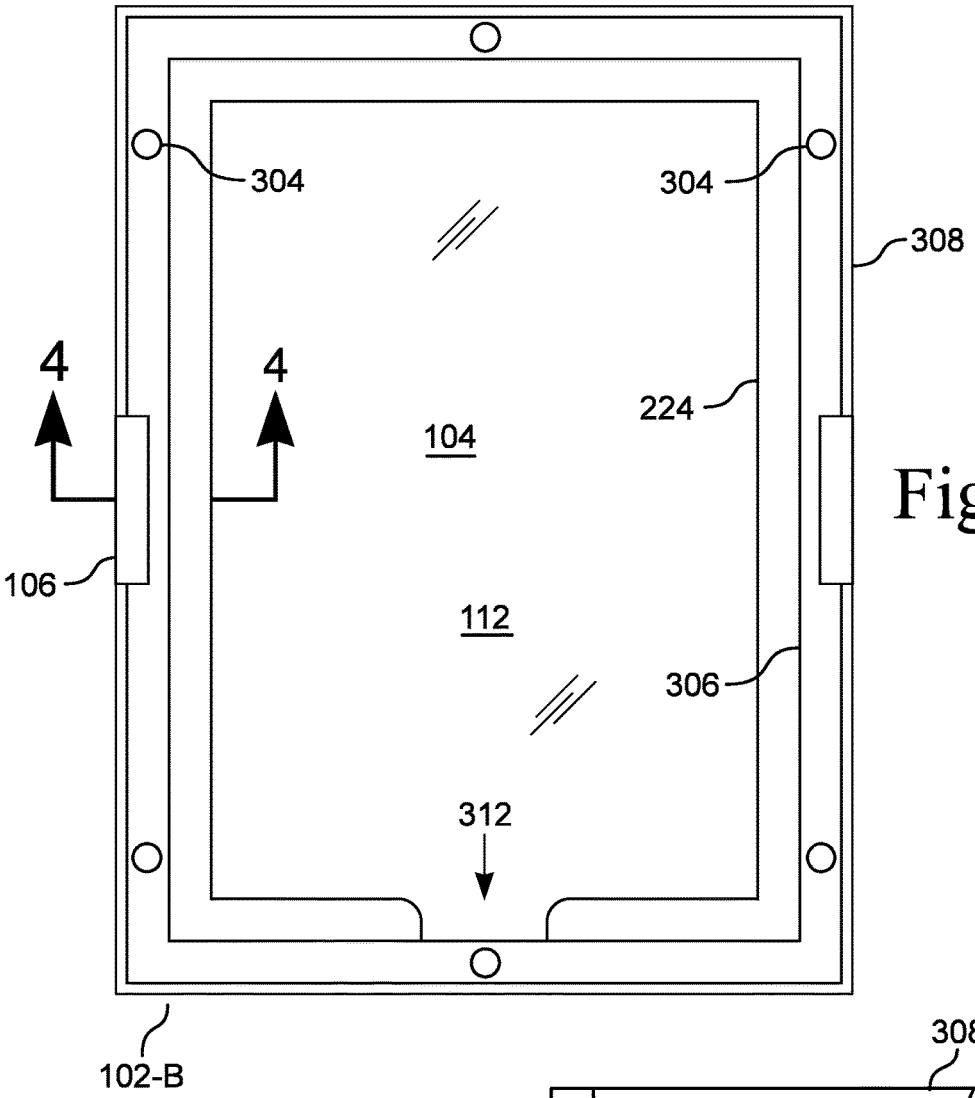
FIG. 3 is a plan view of the rear of another embodiment of a front frame member.
Figure 4:
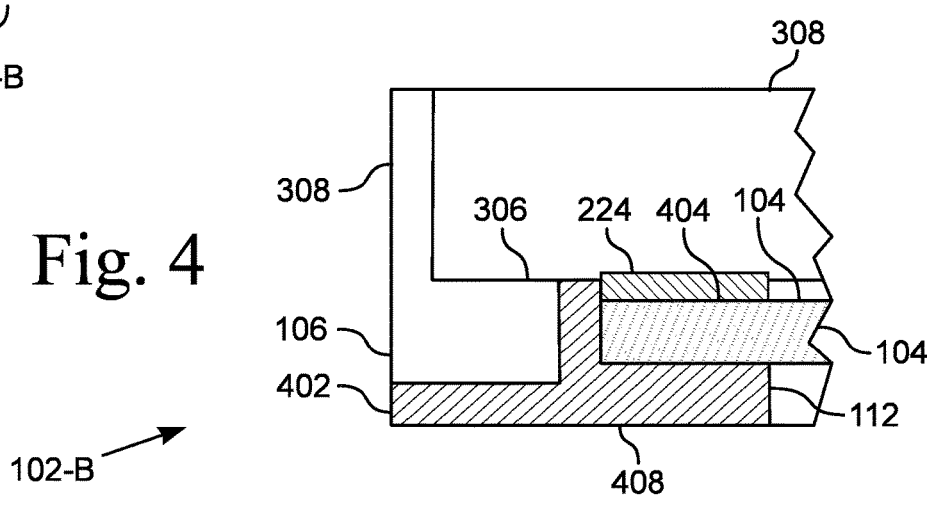
FIG. 4 is a partial cross-sectional view of one embodiment of an outside notch in the front frame member.

FIG. 3 illustrates a plan view of the rear of another embodiment of a front frame member 102-B. FIG. 4 illustrates a partial cross-sectional view of one embodiment of an outside notch 106 in the front frame member 102. The front frame member 102-B includes a front surface 408. Extending from the front surface 408 rearward are four sidewalls 308 that define the periphery of the front frame member 102-B. The front surface 408 presents a frame face between the sidewalls 308 and the edge of the front opening 112. The display frame 100 can be grasped and held by a person by holding the frame 100 between the front surface 408 and the rearmost edge of the sidewalls 308. The edge of the front surface 408 that forms the front opening 112 defines a plane. In the illustrated embodiment the front surface 408 is a planar face. Behind the front surface 408 is a recess 404 that surrounds the front opening 112. The peripheral edge of the front pane 104 fits into the recess 404, where it is secured to the front frame member 102-B such as with an adhesive or mechanical clip or fastener. A resilient material 224 is attached to the rear surface of the peripheral edge of the front pane 104 such as with an adhesive. The rear surface of the resilient material 224 extends slightly rearward past the rear inside surface 306 of the front frame member 102-B.

The display frame 100 includes a latching mechanism. In the illustrated embodiment the latching mechanism includes a plurality of magnets 304 are spaced around the rear surface 306 of the front frame member 102-B. In the illustrated embodiment the magnets 304 are positioned in a recess with the outer surface of the magnets 304 flush with the rear surface 306 of the front frame member 102-B. The magnets 304 are positioned to engage the metal objects 212 on the rear frame member 110-A. In this way when the front and rear frame members 102-B, 110-A are positioned proximately they are held together, or latched, by the magnetic force between the magnets 304 and the metal objects 212. In order to maximize the strength of the magnetic attraction the magnets 304, in one embodiment, are rare earth magnets.

In another embodiment, the magnets 304 are affixed to the rear frame member 110-A and the metal objects 212 are attached to the front frame member 102-A, 102-B. In yet another embodiment, the rear frame member 110-A has magnets instead of the metal objects 212, with the magnets having an opposite polarity as the magnets 304 in the front frame member 102-A, 102-B. In each of these ways the front and rear frame members 102-A, 102-B, 110-A are secured together by magnetic force. Those skilled in the art will recognize that the number of magnets 304 and metal objects 212 will vary based on the size of the display frame 100 and the strength of the magnets 304 without departing from the spirit and scope of the present invention.

The outside notch 106 defines a lip 402 adjacent the front surface 408 of the front frame member 102. A force applied normal to the rear surface of the lip 402 relative to the rear frame member 110 acts against the magnetic force holding the magnets 304 to the metal objects 212.

The illustrated embodiment of the front frame member 102-B includes a blister notch 312 positioned in the bottom edge of the front opening 212. The blister notch 312 is provided to provide clearance for a foot 802 extending from the bottom of the blister 118-A.

Figure 5:
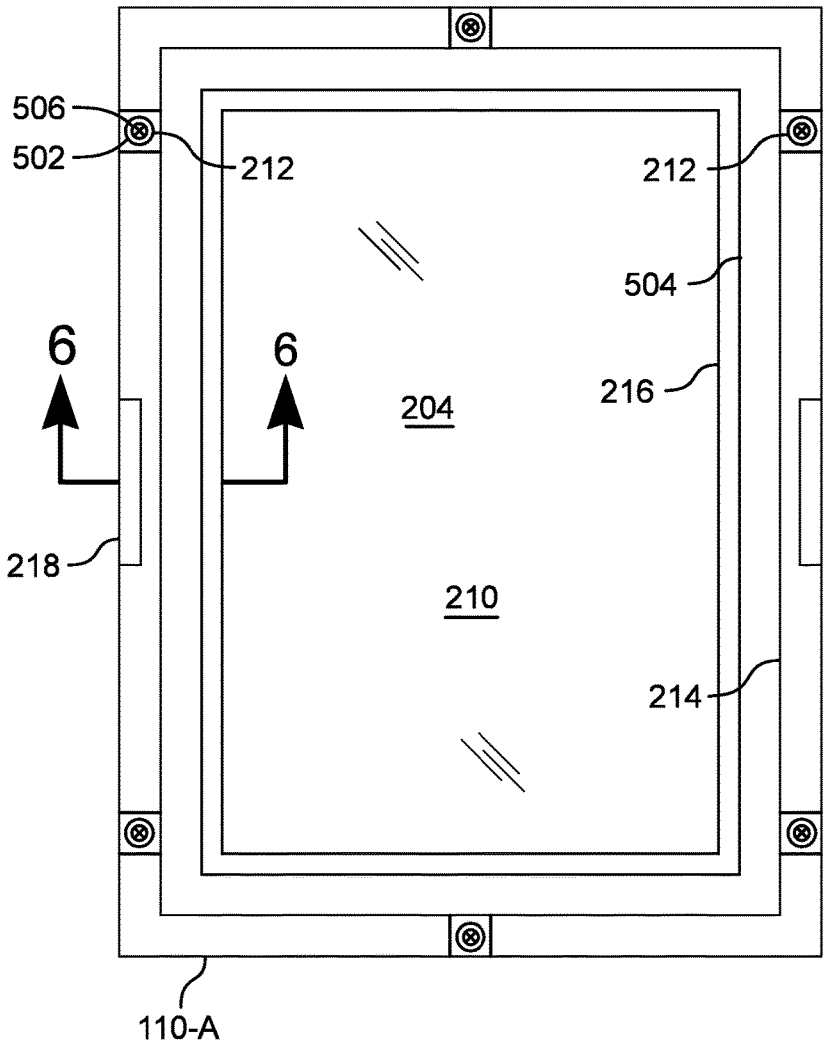
FIG. 5 is a plan view of the front of one embodiment of a rear frame member.
Figure 6:
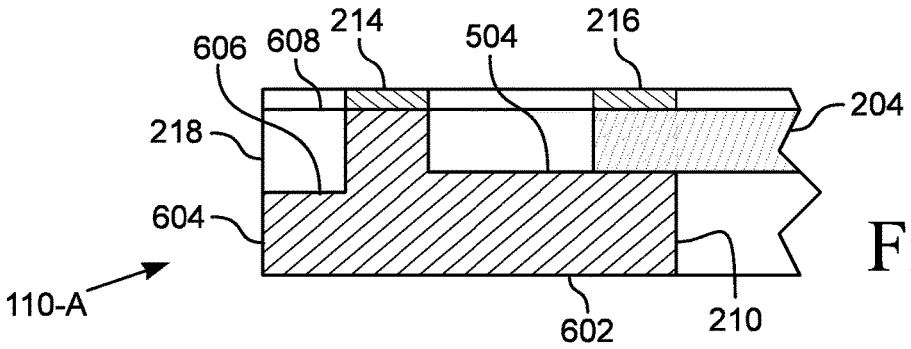
FIG. 6 is a partial cross-sectional view of one embodiment of an inside notch in the rear frame member.

FIG. 5 illustrates a plan view of the front of one embodiment of a rear frame member 110-A. FIG. 6 illustrates a partial cross-sectional view of one embodiment of an inside notch 218 in the rear frame member 110-A. The rear frame member 110-A includes a rear surface 602. The rear frame member 110-A is dimensioned to fit between the sidewalls 308 of the front frame member 102-A, 102-B. Behind the rear surface 602 is a recess 504 that surrounds the rear opening 210. The peripheral edge of the rear pane 204 fits into the recess 504, where it is secured to the rear frame member 110-A. A resilient material 216 is attached to the front surface of the peripheral edge of the rear pane 204. Opposite the rear surface 602 of the rear frame member 110-A is a front surface 608 of the rear frame member 110-A. A resilient material 214 is attached to the front surface 608 of the rear frame member 110-A. The front surfaces of the resilient materials 216, 214 are substantially even.

A plurality of metal objects 212 are spaced around the front surface 608 of the rear frame member 110-A. In the illustrated embodiment the metal objects 212 include a washer 502 secured with a fastener 506, such as a screw, to the front surface 608 of the rear frame member 110-A. For example, the washer 502 is a #8 washer and the fastener 506 is a #4 zinc plated screw. The fastener 506 is countersunk with respect to the washer 502 so that a flat surface is presented for engagement with the corresponding magnet 304 attached to the front frame member 102-A, 102-B. The resilient material 214 extends from the front surface 608 of the rear frame member 110-A the same distance or slightly greater than the distance that the metal object 212 extends from the front surface 608. In this way the resilient material 214 provides a seal and cushion between the front surface 608 of the rear frame member 110-A and the rear surface 408 of the front frame member 102-A, 102-B.

The inside notch 218 defines a lip 604 adjacent the rear surface 602 of the rear frame member 110-A. A force applied normal to the front surface of the lip 606 relative to the front frame member 102-A, 102-B acts against the magnetic force holding the magnets 304 to the metal objects 212.

Figure 7:
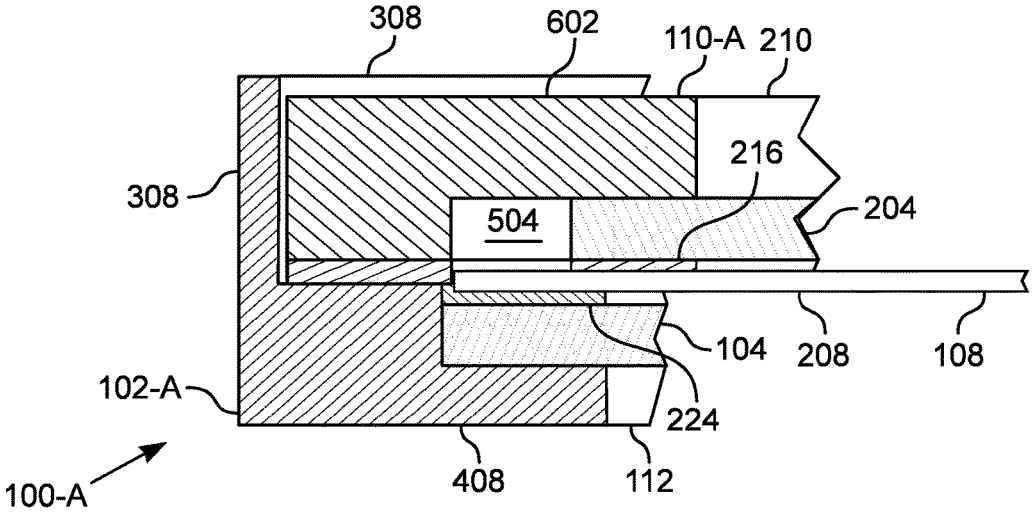
FIG. 7 is a partial cross-sectional view of the collectable sandwiched between the front and rear frame members.

FIG. 7 illustrates a partial cross-sectional view of the collectable 108 sandwiched between the front and rear frame members 102-A, 110-A of a display frame 100-A. The planar portion 208 of the collectable 108 extends around the periphery of the collectable 108. The outer edge of the planar portion 208 is sandwiched between the resilient material 224 on the front pane 104 and the resilient material 216 on the rear pane 204. In this way the collectable 108 is sandwiched between the front and rear panes 104, 204 without the panes 104, 204 applying clamping pressure to the planar portion 208 of the collectable 108.

In one embodiment, the resilient material 214, 216, 224 is a utility fabric rubber sheet. The resilient material 214, 216, 224 is compressible and does not react nor stain the surface of the collectable 108 that it contacts. In one such embodiment the resilient material 214, 216, 224 is adhesively adhered to the rear frame member 110 and the front and rear panes 104, 204. In the illustrated embodiment the thickness of the resilient material 214, 216, 224 is substantially the same as the distance the metal objects 212 extend from the front surface 608 of the rear frame member 110 with the magnets 304 mounted flush with the rear surface 306 of the front frame member 102. In one such embodiment the resilient material 214, 216, 224 is approximately 0.034 inches thick.

FIG. 7 shows the rear surface 602 of the rear frame member 110-A recessed between the sidewalls 308 of the front frame member 102. In various embodiments the rear surface 602 of the rear frame member 100 is either recessed between or flush with the outer edge of the sidewalls 308 of the front frame member 102.

In the illustrated embodiment the rear opening 210 has a smaller width and height relative to the front opening 112. In another embodiment the front and rear openings 112, 210 are the same size. In the illustrated embodiment the resilient material 216, 224 on either side of the planar surface 208 overlaps slightly. The space remaining in the recess 504 is available for those collectables 108 that have a lip or projection at the edge of the planar surface 208.

In one embodiment the display frame 100 does not include the front and/or rear panes 104, 204. In such an embodiment the collectable 108 is still supported by the resilient material 216, 224 but without the panes 104, 204 adjacent the planar portion 208 of the collectable 108. In this way the display frame 100 is configured to receive a wide variety of collectables 108 without requiring a front pane 104 with a front opening 114 specially configured to fit the blister 118.

In another embodiment the front frame member 102 does not have the sidewalls 308. Instead, the front and rear frame members 102, 110 have the same outside dimensions so that the sides of the front and rear frame members 102, 110 are flush.

Figure 8:
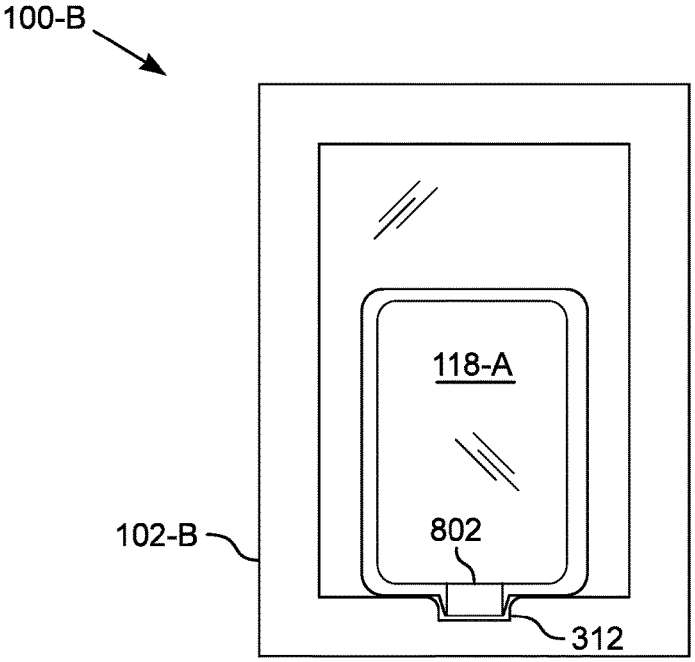
FIG. 8 is a plan view of the front of a second embodiment of a display frame.

FIG. 8 illustrates a plan view of the front of a second embodiment of a display frame 100-B. In the illustrated embodiment of the display frame 100-B the collectable package 108 has a blister 118-A that includes a foot 802. The foot 802 allows the package 108 to stand upright when placed on a flat surface. The front frame member 102-B includes a notch 312 dimensioned and configured to provide clearance for the foot 802 on the blister 118-A. In this way the planar portion 208 of the collectable 108 is supported by the display frame 100-B on both sides of the foot 802.

Figure 9:
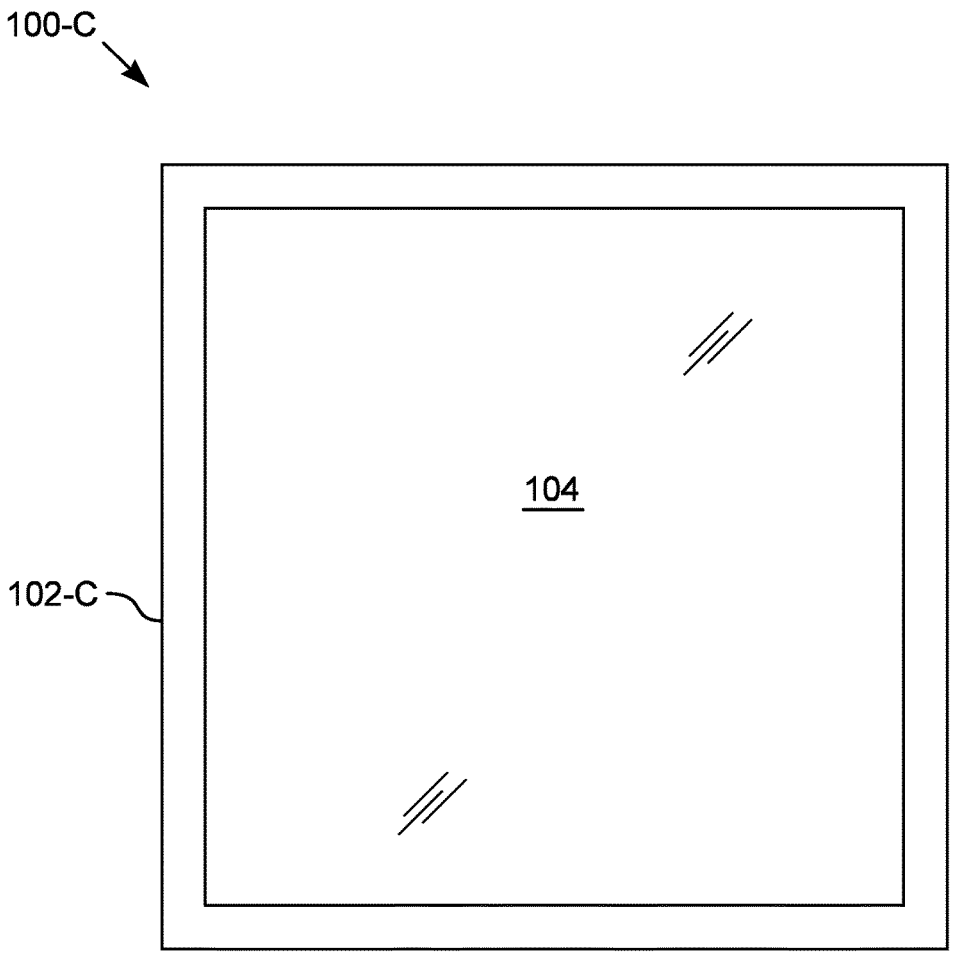
FIG. 9 is a plan view of the front of a third embodiment of a display frame.

FIG. 9 illustrates a plan view of the front of a third embodiment of a display frame 100-C dimensioned and configured to hold a collectable 108 such as a music album. The front frame member 102-C and the rear frame member (not illustrated) are substantially square so as to have the same proportions as the album being displayed.

In one such embodiment the display frame 100-C is configured to receive either a single or double record album. In various embodiments the display frame 100-C has one rear frame member 110 dimensioned to fit a single record album collectable 108 between the front and rear frame members 102, 110 and another rear frame member 110 dimensioned to fit a double record album collectable 108 between the front and rear frame members 102, 110. In yet another embodiment the rear frame member 110 is dimensioned to fit a double record album collectable 108 between the front and rear frame members 102, 110 and a spacer, such as cardboard, is positioned adjace the collectable 108 when a single record album collectable 108 is to be displayed.

In a similar embodiment the display frame 100-C is dimensioned and configured to hold a rectangular collectable 108 such as a poster. In one such embodiment two posters are positioned back-to-back in the display frame 100-C. The frame 100-C includes a hanger that allows the frame 100-C to be hung with either the front or the rear facing away from the wall. In this way the display can be alternated between the two collectables 108 by simply changing the orientation of the frame 100-C without having to open the frame 100-C and replace the collectable 108 with the one to be displayed.

For display frames 100-C that hold collectables 108 without a blister 118, such as albums and posters, the outside and inside notches 106, 218 are positioned at any convenient location, for example, at the top and/or bottom of the display frame 100-C.

Figure 10:
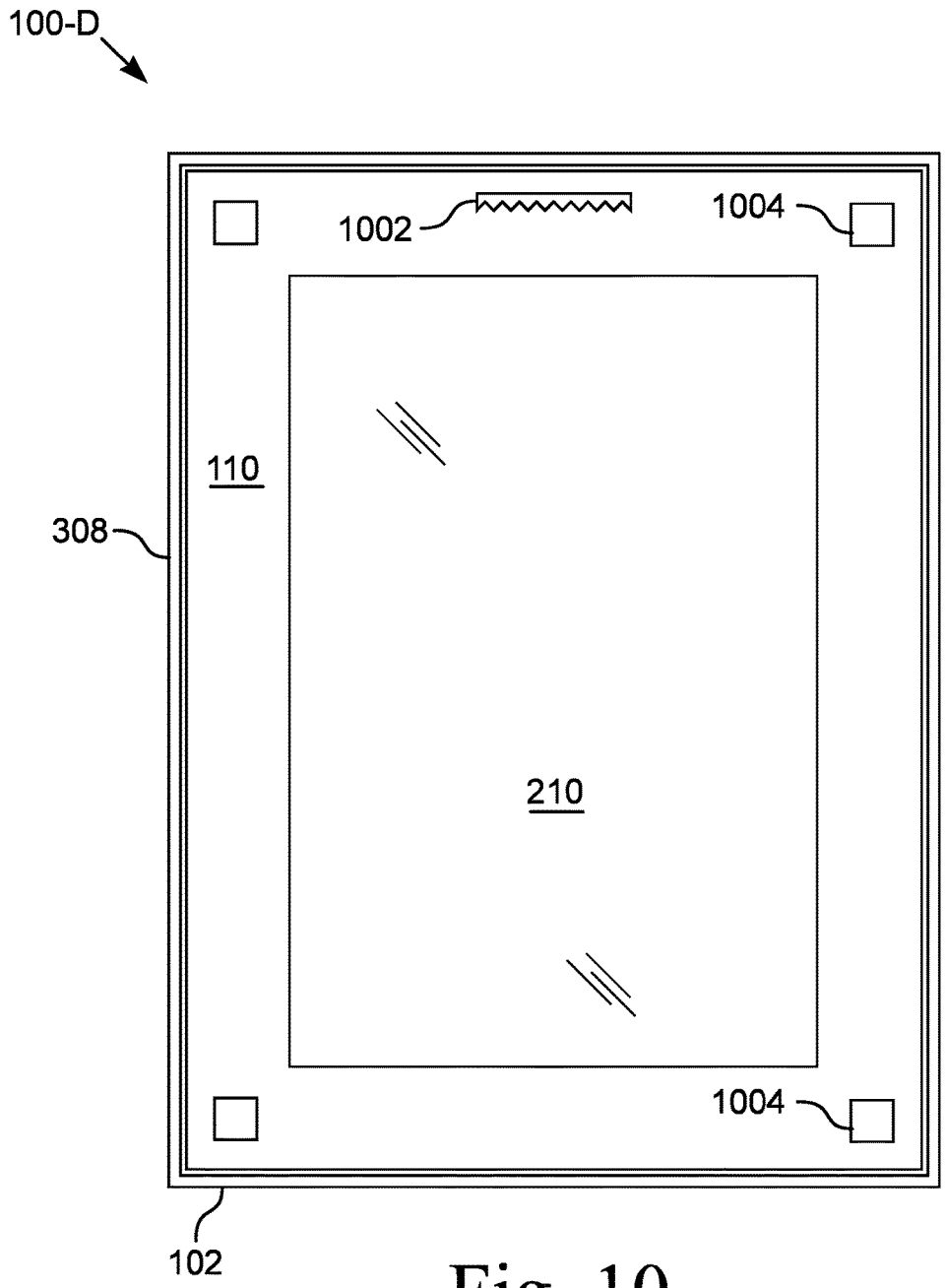
FIG. 10 is a plan view of the rear of a fourth embodiment of a display frame.

FIG. 10 illustrates a plan view of the rear of a fourth embodiment of a display frame 100-D. The rear surface 602 of the frame 100-D includes a hanger 1002 and spacers 1004. In various embodiments the hanger 1002 is configured to engage a nail or other protrusion on a wall. The spacers 1004, in various configurations, are spaced around the rear opening 210 or positioned on the opposite side of the opening 210 from the hanger 1002, that is, near the bottom of the rear surface 602. The spacers 1004 extend beyond the outer edge of the sidewalls 308 of the front frame member 102, thereby preventing the front and rear frame members 102, 110 from touching or contacting the wall on which the display frame 100-D is mounted.

Figure 11:
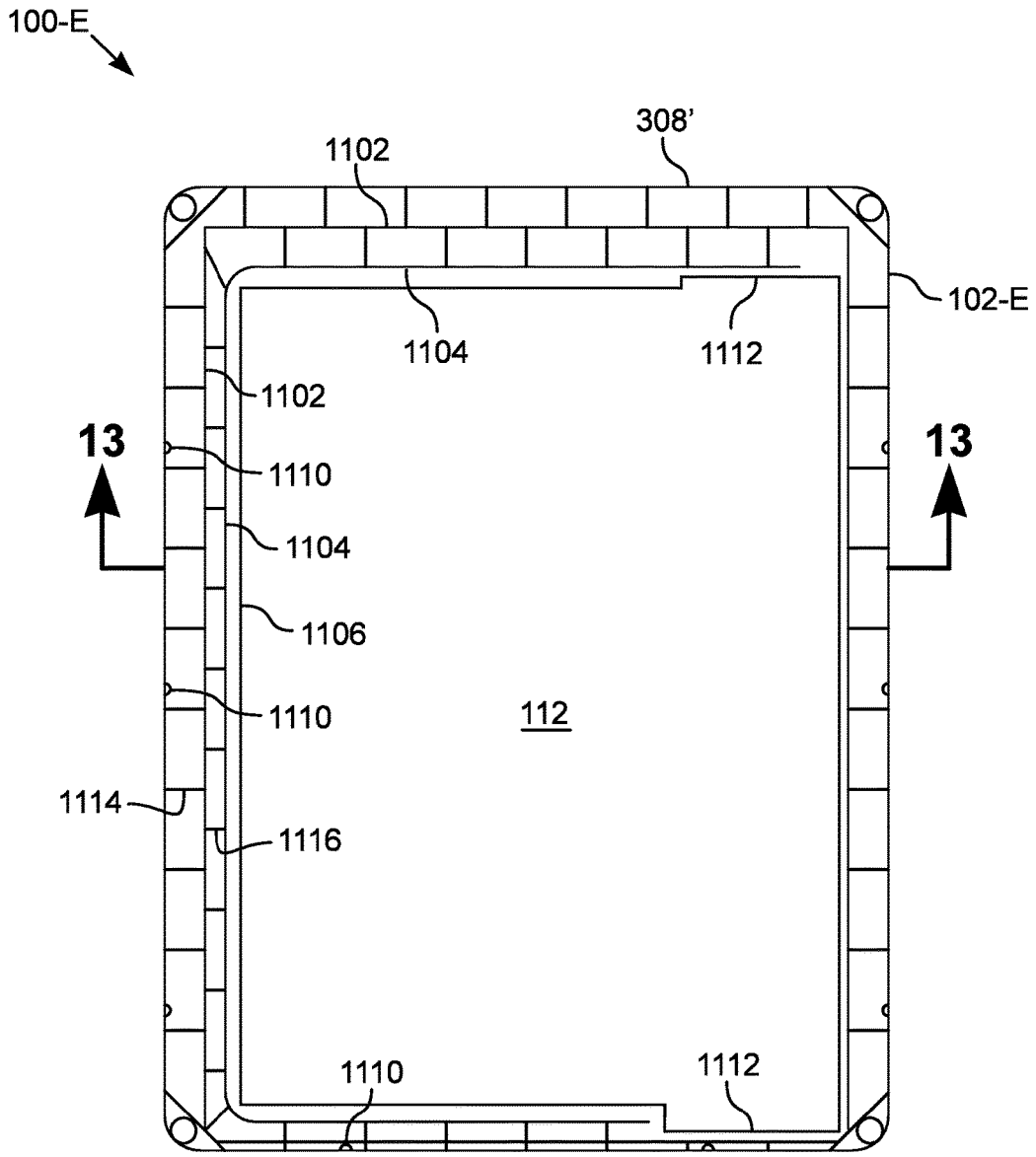
FIG. 11 is a rear plan view of a fifth embodiment of a front frame member for a display frame.
Figure 12:
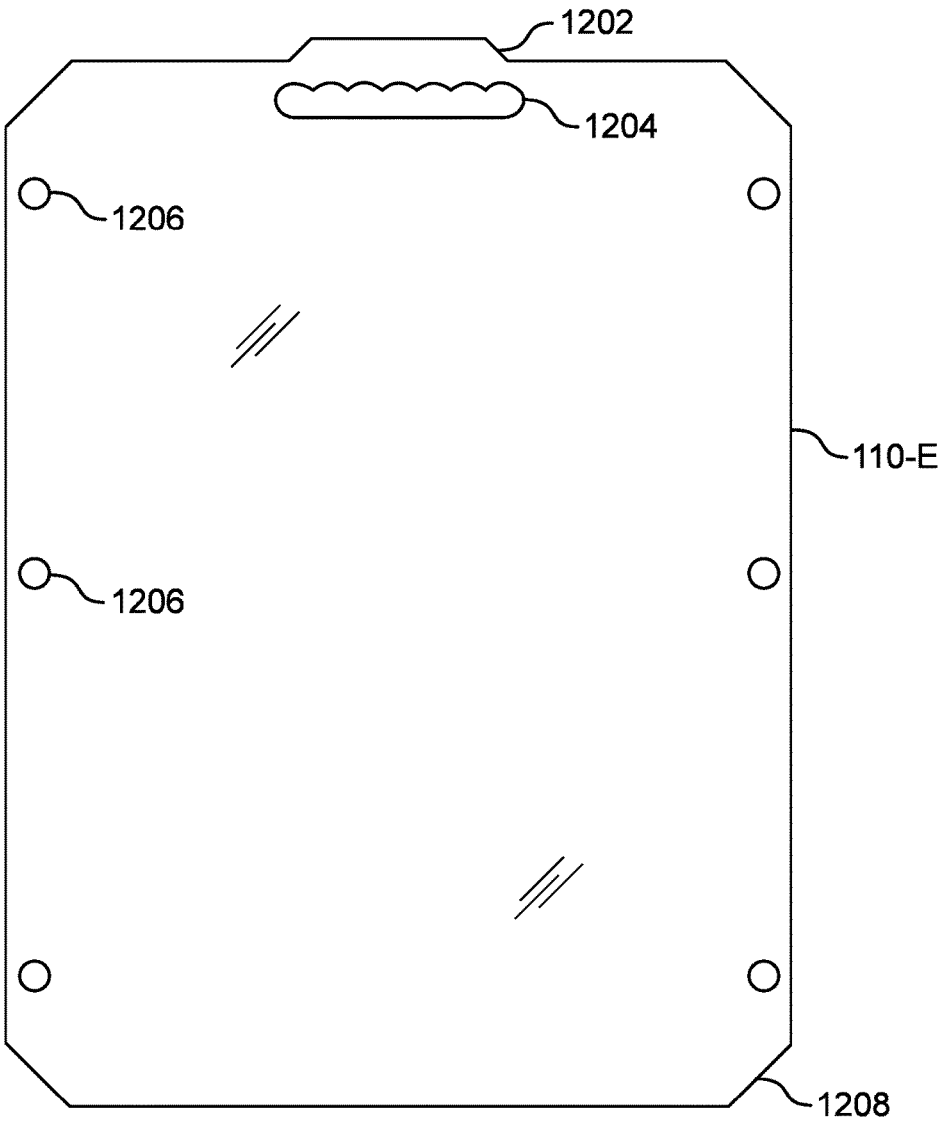
FIG. 12 is a rear plan view of an embodiment of a rear frame member for the display frame shown in FIG. 11.

FIG. 11 illustrates a rear plan view of a fifth embodiment of a front frame member 102-E for a display frame 100-E. FIG. 12 illustrates a rear plan view of an embodiment of a rear frame member 110-E for the display frame 100-E shown in FIG. 11. The display frame 100-E includes the front frame member 102-E and the rear frame member 110-E, which is recessed inside the sidewalls 308' of the front frame member 102-E when the rear frame member 110-E is latched in position.

The front frame member 102-E includes a front opening 112 through which a portion of the collectable 108 protrudes for display. The front frame member 102-E includes a pair of blister notches 1112 to accommodate a blister 118 that protrudes from the planar portion 208 of the collectable 108. Those skilled in the art will recognize that the notches 1112 are positioned and configured to accommodate the blister 118 for the collectable 108 to be displayed through the front opening 112 of the frame 100-E. In the illustrated embodiment the opening 112 defined by the lip 1106 that extends inward from the periphery of the front frame member 102-E. In another embodiment the display frame 100-E includes a front pane 104 that fits inside the front frame member 102-E, such as in the embodiment illustrated in FIGS. 1 & 2. In this embodiment the blister 118 protrudes from the frame 102-E with the front pane 104 protecting the non-blister, or planar, portion 208 of the collectable 108.

The rear frame member 110-E is a planar member that engages the front frame member 102-E. In the illustrated embodiment the rear frame member 110-E is a clear or transparent sheet that allows viewing of the collectable 108. In this regard the rear frame member 110-E performs the same function as the rear pane 204, such as in the embodiment illustrated in FIG. 2. The rear frame member 110-E includes an integral hanger 1204 formed in the material of the member 110-E. The hanger 1204 is an opening in the rear frame member 110-E that is positioned between the sidewall 308' and the frame support ribs 1102. In this way any nail or other support object engaging the hanger 1204 will not contact the collectable 108. In another embodiment a hanger 1002 is attached to the outer surface of the member 110-E. The hanger 1204, 1002 is configured with a horizontal adjustment to allow the frame 100 to be supported squarely when the center of gravity of the collectable 108 is not centered with the centerline of the frame 100.

The rear frame member 110-E has corners 1208 configured to engage the corners inside the front frame member 102-E. In the illustrated embodiment the rear frame member 110-E has diagonally cut corners 1208 that provide clearance for molded corner braces in the front frame member 102-E. Those skilled in the art will recognize that other configurations for mating with the front frame member 102-E can be used without departing from the spirit and scope of the present invention.

Figure 15:
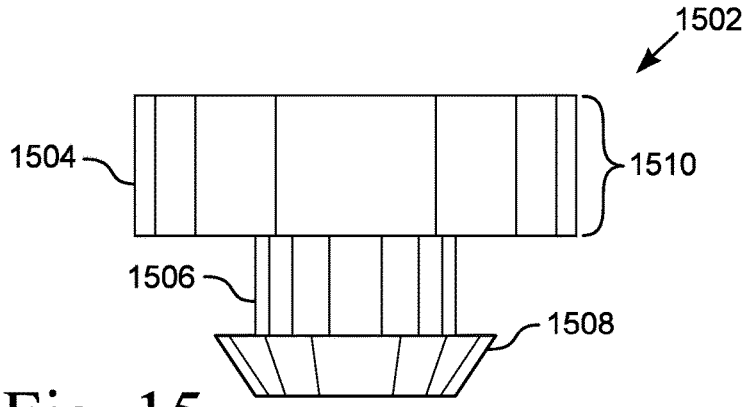
FIG. 15 is a side view of an embodiment of a spacer for the rear frame member shown in FIG. 12.

The rear frame member 110-E also includes openings 1206 that are spaced apart along the periphery of the sheet. These openings 1206 are configured to receive spacers 1502, such as illustrated in FIG. 15. The spacers 1502 are dimensioned and configured to extend rearward past the sidewalls 308' of the front frame member 102-E. In this way the collectable 108 is inserted in the display frame 100-E by first positioning the rear frame member 110-E on a flat surface with the spacers 1502 supporting the rear frame member 110-E. The collectable 108 is positioned on the rear frame member 110-E with the blister 108 or front facing upwards. The front frame member 102-E is then positioned over the collectable 108 such that the front frame member 102-E engages the rear frame member 110-E, thereby locking the frame members 102-A, 110-E together when downward pressure is applied to the front frame member 102-E.

Figure 13:
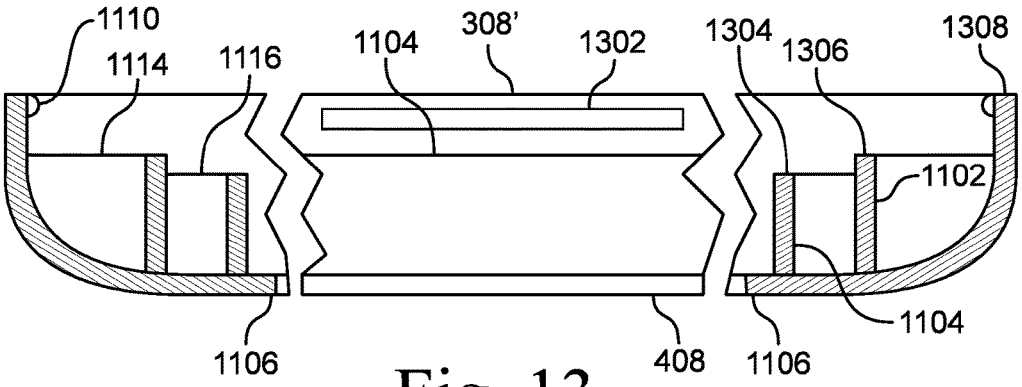
FIG. 13 is a partial cross-sectional view of the front frame member shown in FIG. 11.

FIG. 13 illustrates a partial cross-sectional view of the front frame member 102-E shown in FIG. 11. FIG. 13 illustrates the inside top of the front frame member 102-E, that is, the end of the member 102-E that is at the top of the display frame 100-E when it is mounted on a wall or other vertical support. The top sidewall 308' has a slot 1302 spaced slightly below the rearmost edge 1308 of the sidewall 308'. The slot 1302 is sized and configured to receive the protrusion or tab 1202 on the rear frame member 110-E. The tab 1202 securely supports the front frame member 102-E relative to the rear frame member 110-E both in the front-to-back and the side-to-side directions. The hanger 1204 positioned adjacent the tab 1202 orients the display frame 100-E with the tab 1202 and the slot 1302 at the top of the display frame 100-E when the frame 100-E is hung on a wall or otherwise supported by the hanger 1202.

The front frame member 102-E includes frame support ribs 1102 and collectable support ribs 1104. The frame support ribs 1102 have a rear end 1306 that is spaced a distance inside the front frame member 102-E from the rearmost edge 1308 of the sidewall 308'. The distance between the rear end 1306 of the frame support ribs 1102 and the detents 1110 adjacent the rearmost edge 1308 of the sidewall 308' is sufficient to receive the thickness of the rear frame member 110-E such that the member 110-E is wedged between the detents 1110 and the rear end 1306 of the frame support ribs 1102.

The collectable support ribs 1104 have a rear end 1304 that is spaced a distance inside the front frame member 102-E from the rearmost edge 1306 of the frame support ribs 1102. The distance between the rear end 1304 of the collectable support ribs 1104 and the rear end 1306 of the frame support ribs 1102 is the space in which the planar portion 208 of the collectable 108 fits. With the rear frame member 110-E resting against the rear end 1306 of the frame support ribs 1102, the planar portion 208 of the collectable 108 is supported between the rear frame member 110-E and the rear end 1304 of the collectable support ribs 1104. In various embodiments one or both of the resilient materials 224, 226 are attached to the collectable support ribs 1104 and/or rear frame member 110-E to clamp and cushion the collectable 108 in the display frame 100-E.

Between the sidewalls 308' of the front frame member 102-E and the frame support ribs 1102 are a plurality of first support webs 1114. Between the frame support ribs 1102 and the collectable support ribs 1104 are a plurality of second support webs 1116. The first and second support webs 1114, 1116 provide structural integrity for the front frame member 102-E, which, in the illustrated embodiment, is a molded plastic assembly. Those skilled in the art will recognize that the number, configuration, and placement of the webs 1114, 1116 will vary without departing from the spirit and scope of the present invention.

The illustrated embodiment of the display frame 100-E has a latching mechanism that includes the cooperating tab 1202 and slot 1302 and the cooperating detents 1110 and rear frame member 110-E. The front frame member 102-E includes a series of spaced detents or protrusions 1110 extending inward from the inside of the sidewalls 308' adjacent the rearmost edge 1308 of the sidewall 308'. The detents 1110 are positioned along the sides of the front frame member 102-E and the bottom of the member 102-E, where the bottom is opposite the top where the slot 1302 is located. The detents 1110 extend inward a sufficient distance that when the tab 1202 of the rear frame member 110-E is inserted into the slot 1302 and the rear frame member 110-E is then pushed into the front frame member 102-E against the frame support ribs 1102, the detents 1110 engage the outer corner or edge of the rear frame member 110-E, thereby securing the rear frame member 110-E inside the front frame member 102-E.

Figure 14:
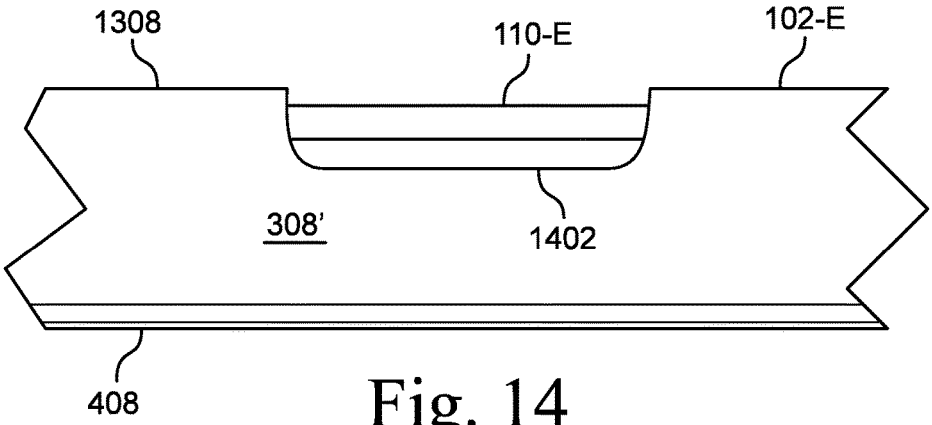
FIG. 14 is a partial view of the bottom of the display frame shown in FIG. 11.

FIG. 14 illustrates a partial view of the bottom of the display frame 100-E shown in FIG. 11. The bottom of the frame 100-E is in reference to the position of the frame 100-E when it is mounted on a wall, such as when it is suspended from the hanger 1204. The bottom sidewall 308' of the front frame member 102-E has a finger notch 1402 that allows a user to access the edge of the rear frame member 110-E in order to bias the lower edge of the rear frame member 110-E away from the front of the front frame member 102-E to disengage the member 110-E from the detents 1110 in the front frame member 102-E. In this way the rear frame member 110-E is unlatched from the front frame member 102-E, thereby allowing the insertion or removal of the collectable 108.

FIG. 15 illustrates a side view of an embodiment of a spacer 1502 for the rear frame member 110-E. The spacer 1502 includes a body 1504, a shaft 1506, and a keeper 1508. The body 1504 has a thickness 1510 sufficient to extend from the rearmost surface of the rear frame member 110-E to beyond the rearmost edge 1308 of the sidewall 308'. The shaft 1506 is cylindrical with a diameter dimensioned to fit into an opening 1206 in the rear frame member 110-E. The keeper 1508 in the illustrated embodiment is resilient with a wedge or truncated conical shape that compresses to fit into the opening 1206 and expand to keep the spacer 1502 secured to the rear frame member 110-E. The spacer 1502 in one embodiment is resilient such that the body 1504 provides cushioning between the rear frame member 110-E and the wall to which the display frame 100-E is hung.

Figure 16:
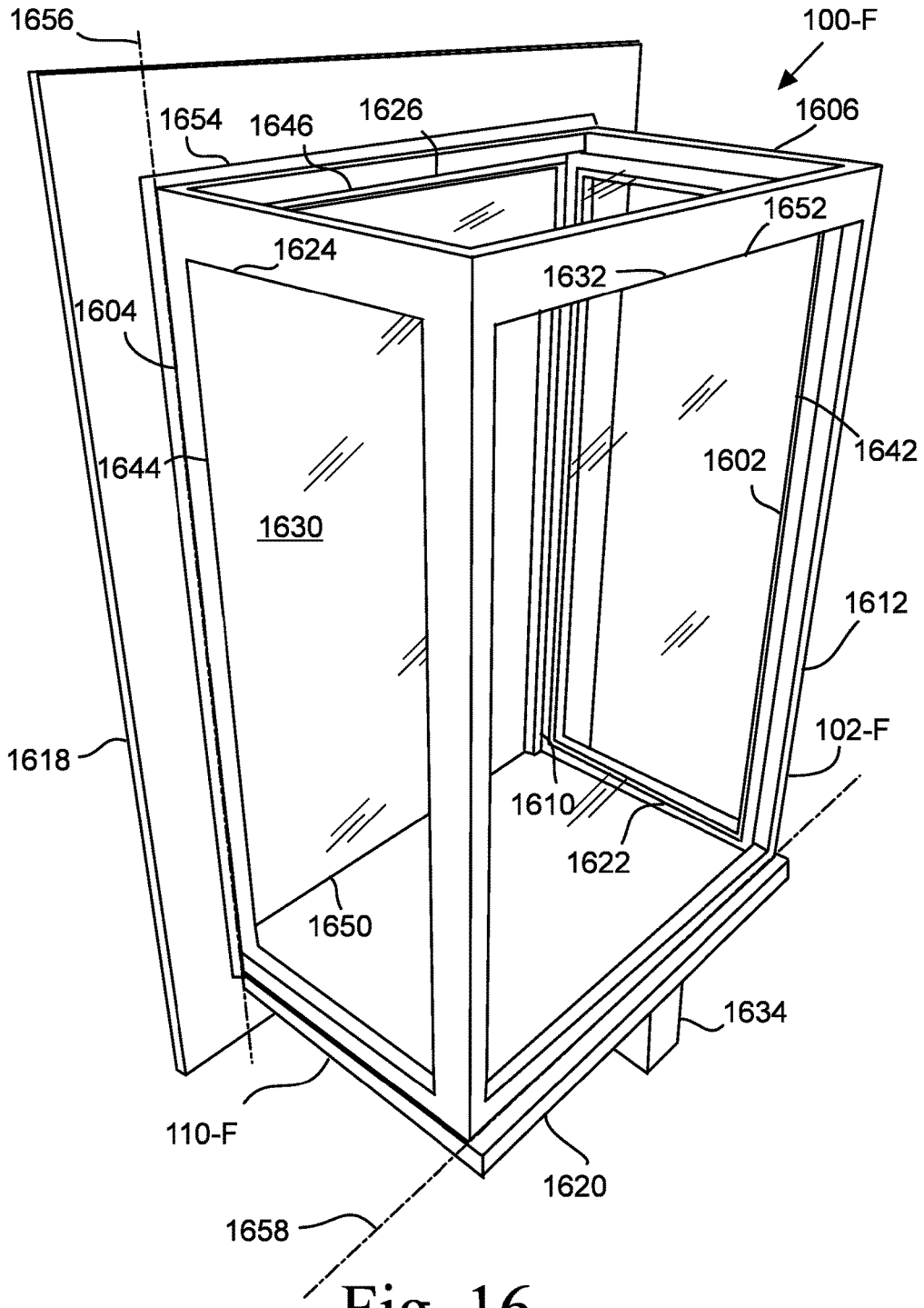
FIG. 16 is a perspective view of one embodiment of a display case.

FIG. 16 illustrates a perspective view of an embodiment of a display case 100-F. The case 100-F includes a front frame member 102-F and rear frame member 110-F. Picture frame 1618 surrounds a vertical portion of rear frame member 110-F, which is partially recessed in the picture frame 1618. The inside volume of the case 100-F is substantially visible from the substantially all of the front, back, left, right and top outer surface.

Front frame member 102-F includes a right wall 1602, left wall 1604, top wall 1606, bottom wall 1608, rear wall 1610, and front wall 1612. Right, left, top, and front walls 1602, 1604, 1606, 16012 each include a transparent portion. Proximate to right wall opening 1642 is right pane 1622, which is recessed into right wall 1602. Proximate to left wall opening is left pane 1624, which is recessed into left wall 1604. Proximate to top opening 1646 is top pane 1626, which is recessed into top wall 1606. Proximate to front opening 1652 is front pane 1632, which is recessed into front wall 1612. Proximate to rear opening 1650 of rear frame member 110-F is a rear pane 1630, which is recessed in backing 1654. Each pane 1622, 1624, 1626, 1630, 1632 is affixed in place by glue. In other embodiments the panes are held in place with metal tabs, or other means well-known to those with ordinary skill in the art. In other embodiments the panes are transparent portions manufactured as integral parts of the respective walls.

Each pane 1622, 1624, 1626, 1630, 1632 is transparent such that the inside of display case 100-F is visible from five walls, i.e., the right, left, front, back, and top.

Figure 17:
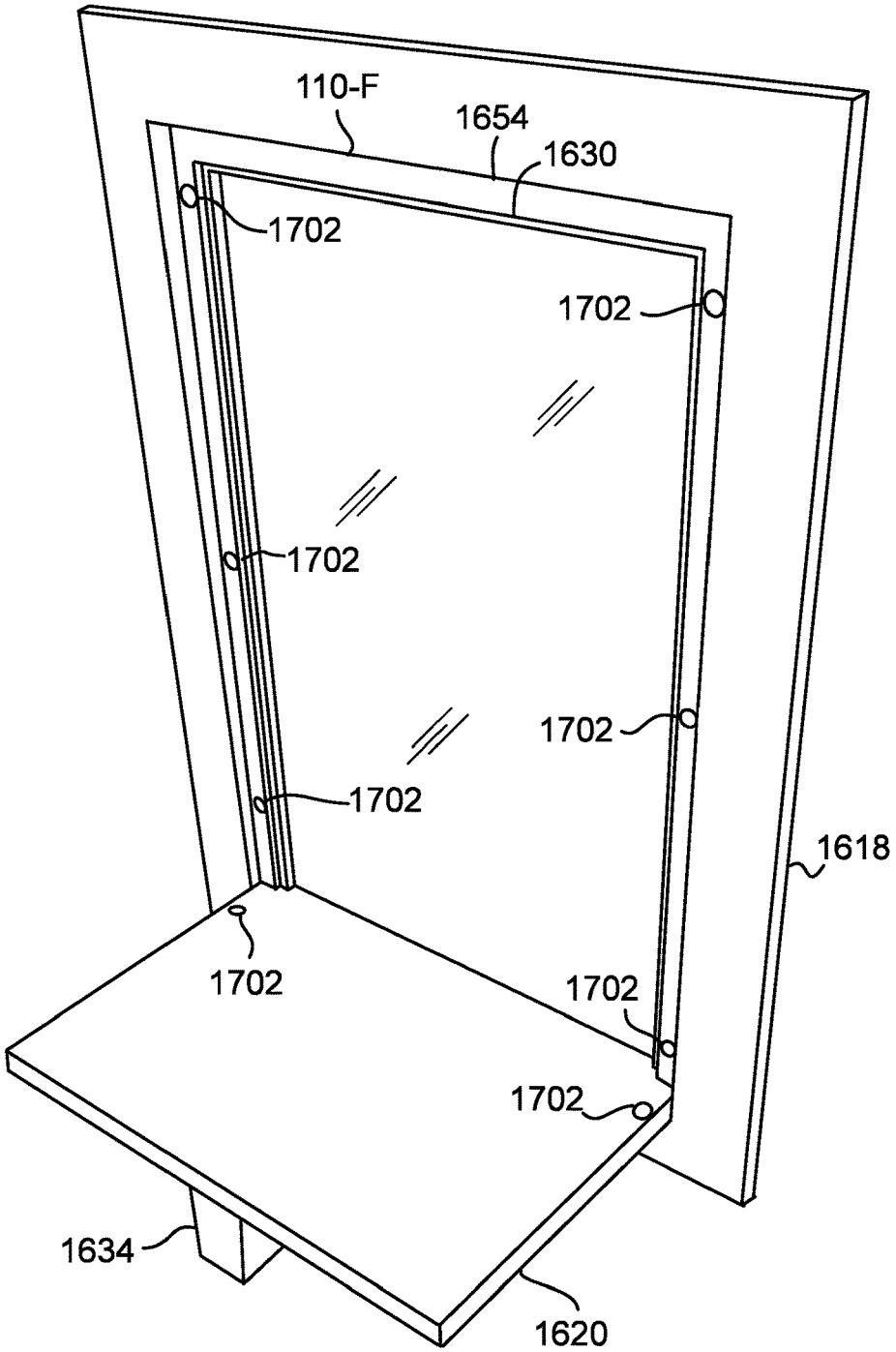
FIG. 17 is a perspective view of a rear frame member of the display case shown in FIG. 16.

FIG. 17 illustrates rear frame member 110-F and surrounding picture frame 1608 which is contiguous with rear frame vertical wall or backing 1654. Backing 1654 is recessed in picture frame 1608. Backing 1654 is slightly greater in height and width than front frame member 102-F rear wall 1610, allowing a clearance and margin of error for mating front frame member 102-F with rear frame member 110-F. Base 1620 extends horizontally from frame 1618. Stand 1634 is affixed to base 1620. Case 100-F rests on stand 1634 and picture frame 1618, which together act as legs for case 100-F. Stand 1634 is at a predetermined height such that base 1602 is horizontal when the case 100-F is placed on a horizontal surface.

Case 100-F includes latches 1702, 1802, embodied here as a combination of magnets 1702 and metal objects 1802. Metal objects 1802 are embodied as a washer and screw combination.

Rear frame member 110-F includes magnets 1702. Magnets 1702 are embedded in base 1602 and backing 1654. Magnets 1702 are of sufficient width to allow for metal objects 1802 to contact magnets 1702 despite ability of front frame member 102-E to shift slightly to the right and left inside picture frame 1618.

Figure 18:
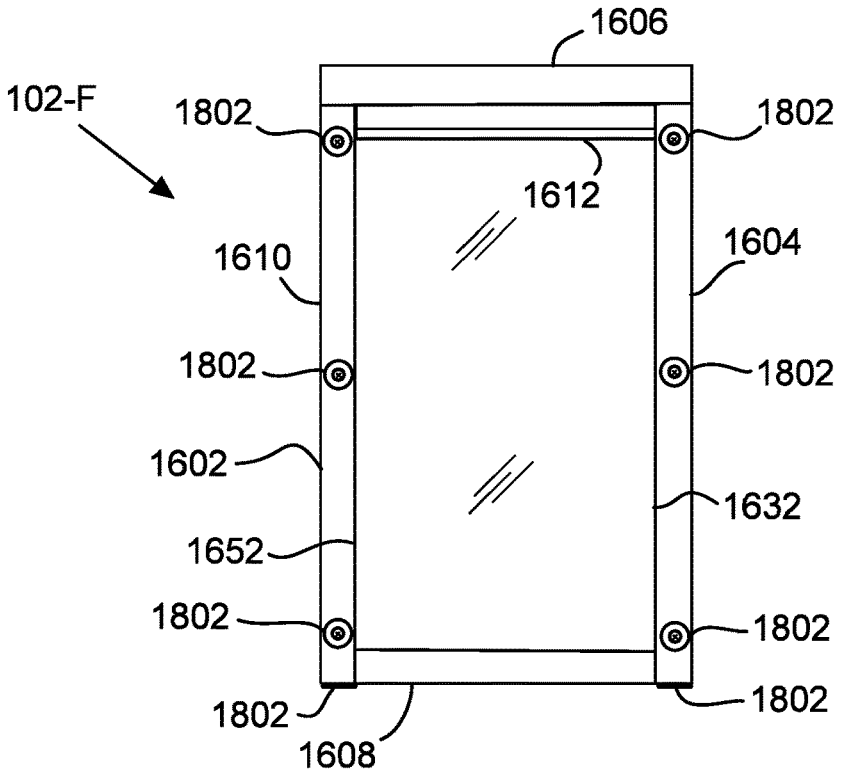
FIG. 18 is a rear plan view of a front frame member of the display case shown in FIG. 16.

FIG. 18 illustrates a rear plan view of front frame member 102-F. Metal objects 1802 are affixed to rear wall 1610. Metal objects 1802 are positioned to align with magnets 1702 on backing 1654 when front frame 102-F is attached to rear frame 110-F as shown in FIG. 17.

Figure 19:
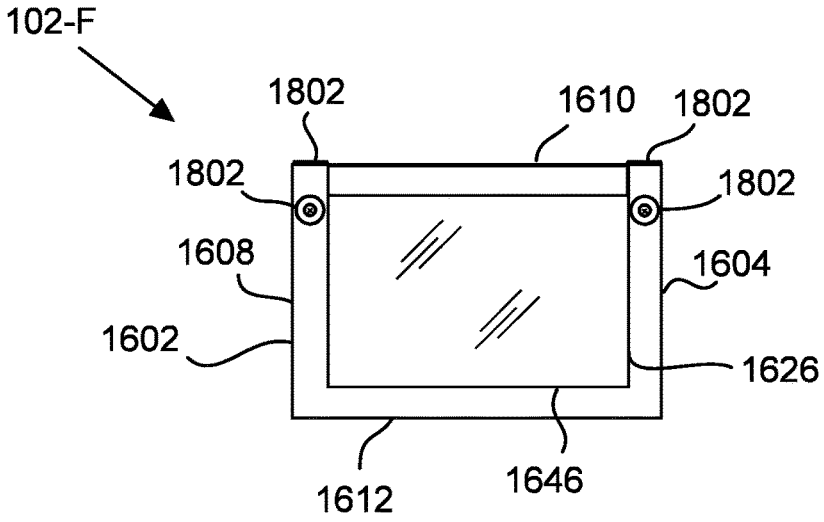
FIG. 19 is a bottom plan view of the front frame member shown in FIG. 18.

FIG. 19 illustrates a bottom plan view of front frame member 102-F. Metal objects 1802 are affixed to bottom wall 1610. Metal objects 1802 are positioned to align with magnets 1702 on base 1620 when front frame 102-F is attached to rear frame 110-F as shown in FIG. 17.

Figure 20:
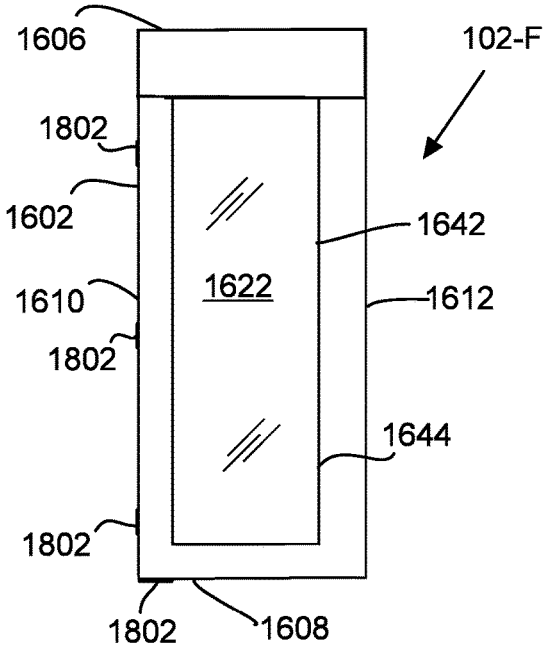
FIG. 20 is a side plan view of the front frame member shown in FIG. 18.

FIG. 20 illustrates a left plan view of front frame member 102-F. Metal objects 1802 protrude from bottom wall 1610 and rear wall 1610.

Figure 21:
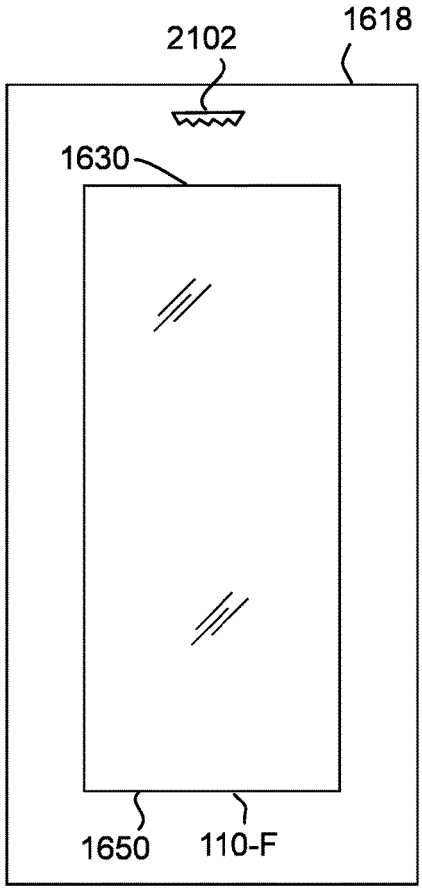
FIG. 21 is a rear plan view the rear frame member shown in FIG. 17.

FIG. 21 illustrates a rear plan view of picture frame 1618. Hanger 2102 is affixed to picture frame 1618, allowing display case 102-F to be hung on a wall.

The attractive force between magnets 1702 and metal objects 1802 is governed by an inverse cube distance law. Thus, there is a gradual (as opposed to step function) reduction in force as metal objects 1802 are pulled away from magnets 1702. The attractive force between magnets 1702 and metal objects 1802 are determined by various factors such as magnetic strength, metal type, and the distance between magnets 1702 and metal objects 1802. Magnets 1702 and metal objects 1802 are configured such that the attractive magnetic force is optimal for the front frame 102-F not to be easily dislodged by jostling or movement, but that the front frame 102-F can be removed smoothly and easily by the user.

Backing 1654 of rear frame member 110-F is recessed in picture frame 1618. Thus, rear wall 1610 of front frame 102-F is partially embedded in picture frame 1618 as well when front and rear frame members 102-F, 110-F are joined.

Front frame member 102-F is prevented from inadvertent removal when display case 100-F is closed, by a combination of magnets 1702 and framing. Front frame member is prevented from being pulled forward, by magnets 1702 in backing 1654. Front frame member is prevented from pushed back, by backing 1654 that is adjacent and superposed with rear wall 1610. Front frame member 102-E is prevented from being pulled up, by magnets 1702 in base 1620. Front frame member 102-E is prevented from being pushed too far left or right, by picture frame 1618 where backing 1654 is recessed.

Backing 1654 of rear frame member 110-F is higher than rear wall 1610 of front frame member 102-E. Thus, if front frame member 102-E is pulled away at the intersection of front wall 1612 and top wall 1606, front frame member will pivot on base 1620 at 1658, which is the intersection of front wall 1612 and bottom wall 1608. As a result, rear wall 1610 will raise up. The additional height of backing 1654 allows rear wall 1610 to clear the picture frame 1618 during this pivot.

Backing 1654 is wider than rear wall 1610 of front frame member 102-E. Thus, if front frame member 102-E is pulled away at the intersection of front wall 1612 and right wall 1602, front frame member 102-E will pivot on backing 1654 at 1656, at the intersection of left wall 1604 and rear wall 1610. As a result, rear wall 1610 will raise up at the right wall 1602. The additional width of backing 1654 allows rear wall 1610 to clear the picture frame 1618 during this pivot.

Figure 22:
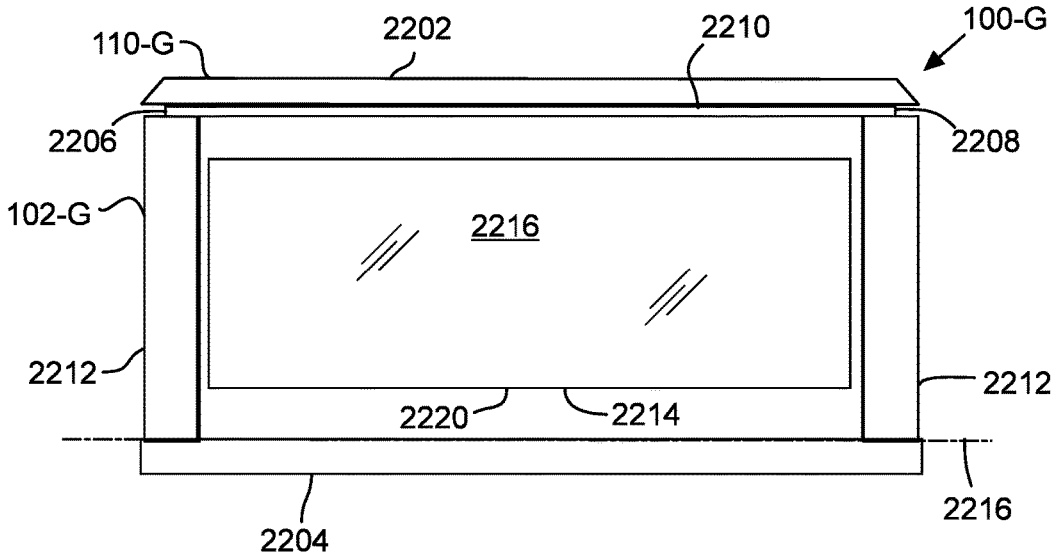
FIG. 22 is a front plan view of a second embodiment of a display case.

FIG. 22 illustrates a front plan view of another embodiment 100-G of a display case. Display case 100-G includes front frame member 102-G and rear frame member 110-G. Rear frame member 110-G includes top wall 2202, bottom wall 2204, left wall 2206, right wall 2208, front wall 2210, and rear wall 2402. In front frame member 102-G, proximate to opening 2214 is front pane 2216, which is recessed into front frame member 102-G. The inside of the display case 100-G is viewable from the front, back, right, left, and top.

Figure 23:
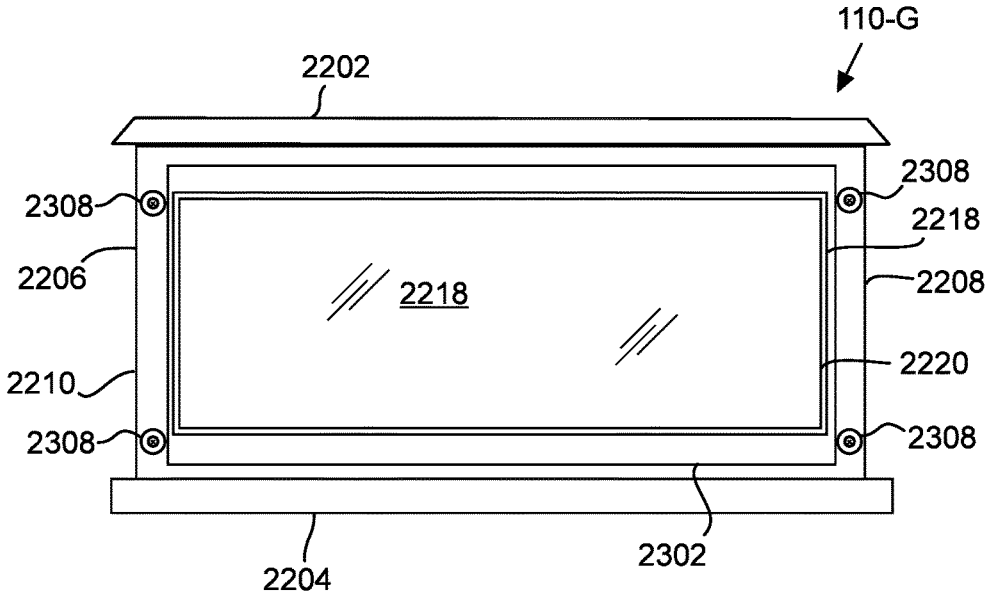
FIG. 23 is a front plan view of the display case shown in FIG. 22, with the front frame member removed.

FIG. 23 illustrates a front plan view of display case 100-G with front frame member 102-G removed. Proximate to rear opening 2220 is rear pane 2218, which is recessed into rear wall 2032.

Figure 24:
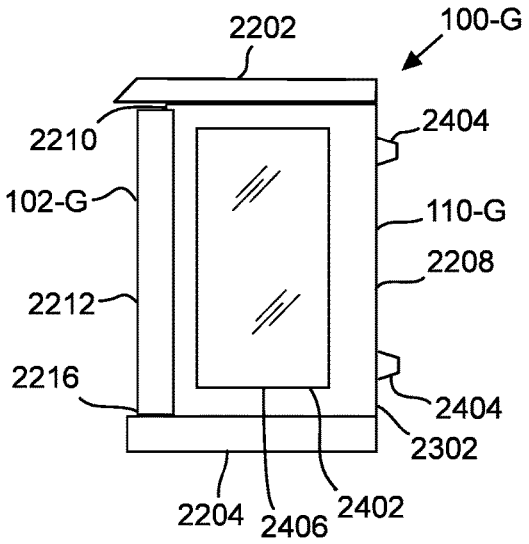
FIG. 24 is a side plan view of the display case shown in FIG. 22.
Figure 25:
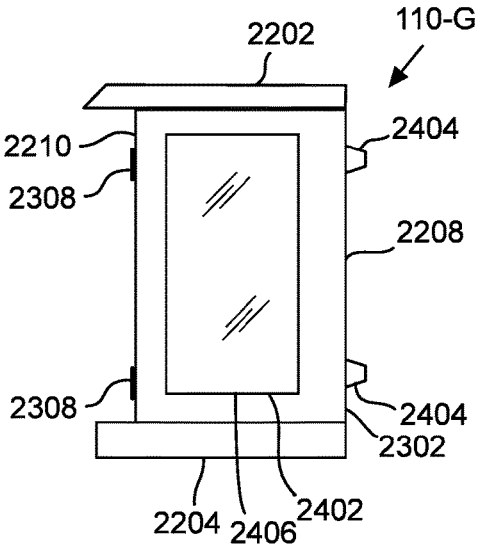
FIG. 25 is a side plan view of the display case shown in FIG. 22, with the front frame member removed.

FIG. 24 illustrates a side plan view of display case 100-G, while FIG. 25 illustrates the same view with the front fame member 102-G removed. Proximate to right opening 2402 is right pane 2406, which is recessed into right wall 2208. Spacers 2404 are affixed to rear wall 2402. In other embodiments, spacers 2404 are attached to bottom wall 2204.

Figure 26:
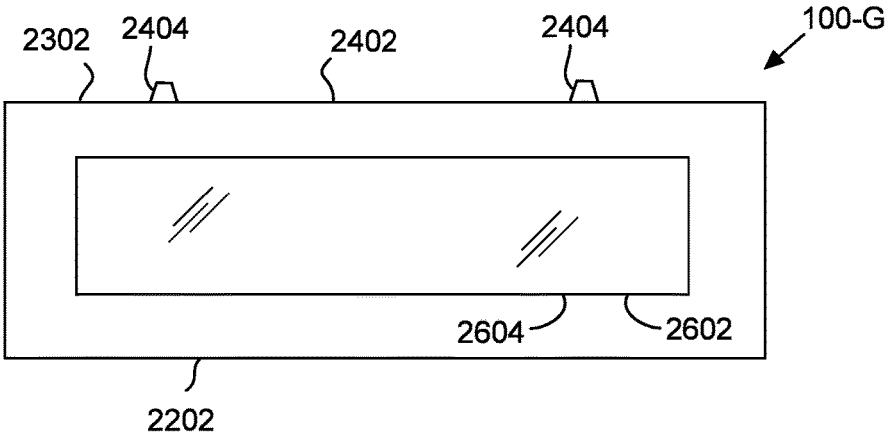
FIG. 26 is a top plan view of the display case shown in FIG. 22.

FIG. 26 illustrates a top plan view of display case 100-G. Proximate to top opening 2602 is top pane 2604, which is recessed into top wall 2202.

Figure 27:
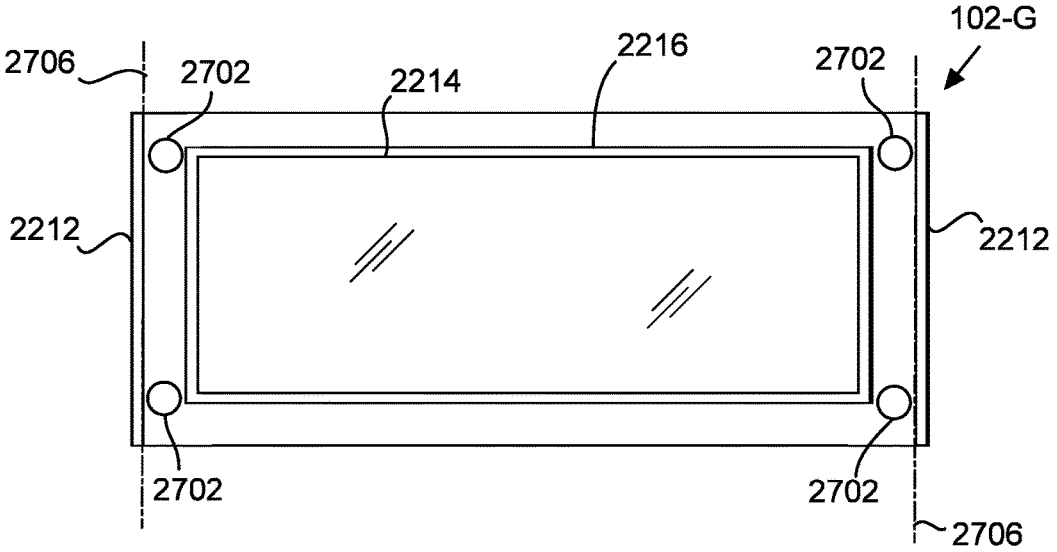
FIG. 27 is a rear plan view of the front frame member of the display case shown in FIG. 22.
Figure 28:
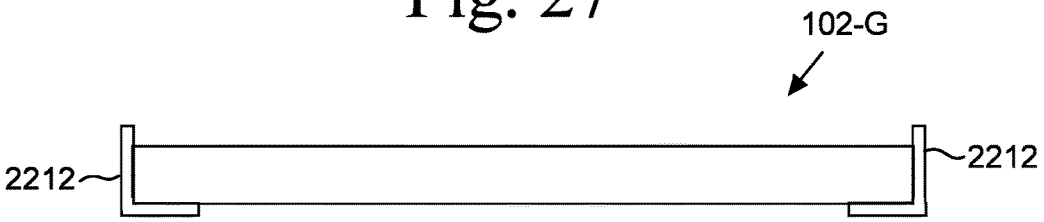
FIG. 28 is a top plan view of the front frame member shown in FIG. 27.
Figure 29:
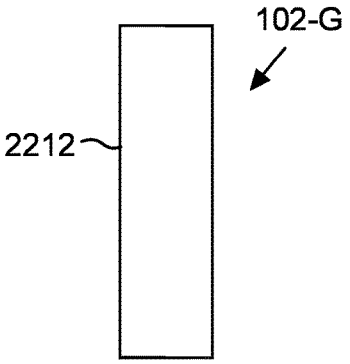
FIG. 29 is a side plan view of the front frame member shown in FIG. 28.

FIG. 27 illustrates a rear plan view of front frame member 102-G. FIG. 28 illustrates a top plan view of front frame member 102-G. FIG. 29 illustrates a side plan view of front frame member 102-G. Magnets 2702 are embedded into frame member 102-G. Magnets 2702 are located such that metal objects 2308 and magnets 2702 physically touch when front frame member 102-F is placed on front wall 2210, as shown in FIG. 22.

Top wall 2202 and bottom wall 2204 of second frame member 110-G extend horizontally beyond front wall 2210. Thus, front frame member 102-G is prevented from moving a great distance up or down when magnetically attached to front wall 2210.

Front frame member 102-G includes lips 2212 that extend past front wall 2210 when front frame member 102-G is magnetically attached to front wall 2210. Thus front frame member is prevented from moving a great distance left or right when magnetically attached to front wall 2210.

The gap between top wall 2202 and bottom wall 2204 of rear frame member 110-G is greater than the height of front frame member 102-G. Thus, one method of removing front frame member 102-G is by pulling front frame member 102-G just from its top, thus causing front frame member to pivot on rear frame member bottom wall 2204, at 2216. The lesser height of front frame member 102-G allows it to clear top wall 2202 during this pivot.

The gap between lips 2212 of front frame member 102-G is greater than the width of second frame member front wall 2210. Thus even when the display case 100-G is closed, the lips 2212 are configured to be spaced a distance from the second frame member right and left walls 2208, 2210. Lips 2212 are grasped as leverage to remove the front frame member 102-G. Also, if front frame member 102-G is pulled by its right or left side, there is sufficient space so that lips 2212 can clear and not scrape right wall 2208 or left wall 2206. When being removed in this matter the front frame member 102-G pivots on one lip edge, at 2706.

The display case 100 includes various functions. The function of smoothly disengaging the first frame 102-F from the second frame 110-F is implemented, in one embodiment, by pivot edge 1658 and heightened backing 1654. In another embodiment the function of smoothly disengaging the first frame 102-G from the second frame 110-G is implemented by pivot edge 2706 and lips 2122 that are spaced from the second frame's right and left side 2206, 2208.

The function of the inside of the case 100 being viewable from substantially all of the outer surface above the base 1620 of the case 100 is implemented, in one embodiment, by the transparent portions 1622, 1624, 1626, 1630, 1632 of the top, left, right, front, and back of the case.

The function of accommodating a blister 118 of the packaging of a collectable 108 is implemented, in one embodiment, by the front opening 114 in the front pane 104, such as illustrated in FIGS. 1 and 2. In another embodiment the function of accommodating a blister 118 of the packaging of a collectable 108 is implemented by one or more blister notches 312, 1112 formed in the edge of the opening 112 of the front frame member 102.

The function of supporting the collectable 108 is implemented, in one embodiment, by the resilient material 216, 224 protruding from the rear and front panes 204, 104, respectively. In this way the collectable 108 is evenly supported, thereby preventing sagging or other damage to the collectable 108 from being displayed vertically. In another embodiment the function of supporting the collectable 108 is implemented by the front pane 104 positioned adjacent the flange extending from the sides of the blister 118. In this way the front pane 104 provides support to the flange and prevents the blister 118 from being pulled off or separating from the planar section 208 of the collectable 108.

The function of protecting the surface of the collectable 108 is implemented, in one embodiment, by the front and rear panes 104, 204. The front and rear panes 104 allow the display frame 100 to be handled while preventing direct contact with the planar surface 208 of the collectable 108. In this way the planar surface 208 of the collectable 108 is protected from finger prints or being otherwise marked or damaged.

The function of clamping the collectable 108 in the display frame 100 is implemented, in one embodiment, by the front and rear panes 104, 204 being forced against the front and rear surfaces of the planar portion 208 of the collectable 108. In such an embodiment the clamp includes the front and rear panes 104, 204 as jaws for clamping the collectable 108. In another embodiment the function of clamping is implemented by the clamp that includes the resilient material 224 on the front pane 104 and the resilient material 216 on the rear pane 204 as jaws for clamping the collectable 108 near its peripheral edge, such as illustrated in FIG. 7. The resilient material 224, 226 is a cushion that prevents damage to the collectable 108 by the clamp. In yet another embodiment the function of clamping is implemented by the clamp that includes the collectable support ribs 1104 and the rear frame member 110-E as jaws for clamping the collectable 108 near its peripheral edge while also providing support to the rear of the collectable 108 by the rear frame member 110-E. In one such embodiment, the resilient material 224, 226 is attached to the ribs 1104 and rear member 110-E, respectively, as cushions that prevent damage to the collectable 108 by the clamp.

The function of securing the front and rear frame members together is implemented by a latching mechanism, which, in one embodiment, includes the magnets 304 and metal objects 212 attached to the front and rear frame members 102, 110. In another embodiment the function of securing the front and rear frame members 102-E, 110-E together is implemented with the latching mechanism that includes the tab 1202 engaging the slot 1302 and the detents 1110 engaging the rear frame member 110-E. In yet another embodiment, the function of securing the front and rear frame members 102-E, 110-E together is implemented with the latching mechanism that includes the tab 1202 engaging the slot 1302 and the magnetic assembly that includes magnets 304 and metal objects 212.

The function of separating the front and rear frame members 102, 110 is implemented, in one embodiment, by the outside and inside notches 106, 218 that provide opposing lips 402, 604 that can be pushed apart to break the magnetic bond from the magnets 304, such as illustrated in FIGS. 3-6. In another embodiment the function of separating the front and rear frame members 102-E, 110-E is implemented with the finger notch 1402 in the bottom of the front frame member 102-E, such as illustrated in FIG. 14.

The function of separating the front and rear frame members 102, 110 smoothly is implemented, in one embodiment, by magnets 1702 and metal objects 1802. The rear of the front frame member is slightly less in area than the backing 1654 of the rear frame member, which in turn is encompassed by a picture frame 1618. The front frame member 102 may be grasped and pulled at a front edge, thus pivoting and levering the front member 102 away from the rear member 110. The larger area of the backing allows the rear side 1610 of the front frame member 102 to clear the picture frame 1618 while pivoting away.

In another embodiment the function of separating the front and rear frame members 102, 110 is implemented by a pull tab or opening, such as the inside notch 218, in the rear frame member 110. The pull tab is attached to the rear frame member 110 and allows the rear frame member 110 to be pulled away from the front frame member 102. In such an embodiment the outside notch 106 is not necessary and the sidewalls 308 are smooth without any openings or notches.

The function of supporting the rear frame member laterally is implemented, in one embodiment, by the sidewalls 308 of the front frame member 102. The rear frame member 110 is dimensioned to fit inside the sidewalls 308 of the front frame member 102. The latching mechanism, such as the magnets 304 and metal objects 212 or the tab 1202 and slot 1302 with the detents 1110, secure the frame members 102, 110 front to back and the sidewalls 308, 308' prevent the rear frame member 110 from being displaced laterally.

The function of hiding the seam between the front and rear frame members 102, 110 is implemented, in one embodiment, by the sidewalls 308 that extend flush with or slightly beyond the rear surface 602 of the rear frame member 110.

From the foregoing description, it will be recognized by those skilled in the art that a display frame 100 has been provided. The display frame 100 has a front frame member 102, a rear frame member 110, a clamp, and a latch.

The front frame member 102 has a front surface 408 that surrounds an opening 112 and sidewalls 308, 308' that extend around the periphery of the front frame member 102. The front frame member 102 allows viewing of the collectable 108 from the front. In one embodiment the front frame 110 is used with a transparent front pane 104 configured to cooperate with the front of the collectable 108. For collectables 108 that have a blister or bubble 118, the front frame member 102 includes notches 312, 1112 that provide clearance for the blister 118, and, for those embodiments with a front pane 104, the pane 104 includes an opening or cutout 114 that allows the blister 118 to protrude through the pane 104.

The rear frame member 110 fits into the front frame member 102. The rear frame member 110 allows viewing of the collectable 108 from the rear. In one embodiment the rear frame member 110-A includes an opening 210 with a transparent rear pane 204. In another embodiment the rear frame member 110-E is a sheet with a transparent portion.

The clamp has members that secure the collectable 108 between the frame members 102, 110. In one embodiment the resilient material 224, 226 are the members that clamp and cushion the collectable 108. In various embodiments the resilient material 224, 226 is attached to the front and rear panes 104, 204 or the collectable support ribs 1104 and the rear frame member 110-E. In another embodiment the collectable support ribs 1104 and the rear frame member 110-E are the members that clamp the collectable 108. In yet another embodiment the front and rear panes 104, 204 are the members that clamp.

The latch, in one embodiment, includes the magnets 304 and metal objects 212 that are attached to the front and rear frame members 102, 110. In another embodiment the latch includes the detents 1110 and the rear frame member 110-E. In one embodiment the latch includes the tab 1202 and slot 1302.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for displaying a collectible within an inside volume of an enclosure, said apparatus comprising:

a first frame member having a first wall, wherein said first wall includes a transparent portion, said first frame member including a pair of opposing lips extending perpendicularly from said first wall;

a second frame member having at least four walls wherein a first wall of said at least four walls includes an opening, and wherein a second wall and a third wall of said at least four walls each include a transparent portion, and wherein a fourth wall of said at least four walls is configured as a base supporting said first and second frame members on a horizontal surface;

at least one latch configured to secure said first frame member to said second frame member;

wherein said first frame member mates with said second frame member in a first position to define said inside volume of said enclosure, when in said first position said first wall of said first frame member is parallel with said first wall of said second frame member and said second and third walls of said second frame are positioned between said pair of opposing lips of said first frame member, when in said first position said first wall of said first frame member is supported on a portion of said base extending beyond said first wall of said second frame member, said first frame member releasably removable from said second frame member, and wherein each one of said at least one latch includes a magnet and a metal object that engages said magnet to latch said first frame member to said second frame member, one of said magnet and said metal object attached to said first frame member, and an other one of said magnet and said metal object attached to said second frame member.

2. The apparatus of claim 1 wherein said apparatus further comprises:

a first edge, wherein said first edge is a lower outer edge of said first wall of first frame member, and wherein said first edge is parallel and adjacent to said fourth wall of said second frame member; and wherein said apparatus is configured to pivot on said first edge between said first position and a second position, wherein in said second position said first wall of said first frame is disengaged from said first wall of said second frame.

3. The apparatus of claim 1 wherein each said magnet of said at least one latch is embedded in said first frame member such that each said magnet does not extend beyond any surface of said second frame member.

4. The apparatus of claim 1 wherein said first and second frame members are configured such that with said first and second frame members in said first position, said first walls of said first and second frame members are superposed.

5. The apparatus of claim 1 wherein said first and second walls of said second frame member are rectangles.

6. The apparatus of claim 1 further comprising a fifth wall of said second frame member, wherein said fifth wall of said second frame member includes a transparent portion, wherein said fourth and fifth walls of said second frame member are not adjacent to each other and are both adjacent to said first wall of said second frame member, and wherein said first frame member is shorter than a gap between said fourth and fifth walls of said second frame member.

7. The apparatus of claim 1 wherein a back surface of second frame member includes a hanger configured to attach said second frame member to a wall.

8. The apparatus of claim 1, said first and second frame members are hingeless.

9. The apparatus of claim 1, said at least one latch does not move independently of said first and second frame members.

10. The apparatus of claim 1, said first and second frame members move together to form said enclosure when said first and second frame members are substantially aligned.

11. The apparatus of claim 1, said at least one latch is not visible when said first and second frame members form said enclosure.

12. An apparatus for displaying a collectible within an inside volume of an enclosure, said apparatus comprising:

a first frame member having a first wall and two lips, wherein said first wall includes a transparent portion, and wherein said two lips are on opposite ends of said first wall and wherein said two lips are parallel;

a second frame member having at least four walls wherein a first wall of said at least four walls includes an opening, and wherein a second wall and a third wall of said at least four walls each include a transparent portion, and wherein a fourth wall of said at least four walls is configured as a base supporting said first and second frame members on a horizontal surface, said base extending beyond said first wall such that said first frame member is supported thereupon;

at least one latch configured to secure said first frame member to said second frame member;

wherein said first frame member mates with said second frame member in a first position to define said inside volume of said enclosure; and when in said first position one of said two lips is parallel and proximate with at least a portion of said second wall of said second frame member; and such that an other one of said two lips is parallel and proximate with at least a portion of said third wall of said second frame member, when in said first position said first wall of said first frame member is supported on a portion of said base extending beyond said first wall of said second frame member, said first frame member releasably removable from said second frame member;

wherein each one of said at least one latch includes a magnet and a metal object that engages said magnet to latch said first frame member to said second frame member, one of said magnet and said metal object attached to said first frame member, and an other one of said magnet and said metal object attached to said second frame member.

13. The apparatus of claim 12 wherein said apparatus further comprises:

a second edge, wherein said second edge is an edge of said first wall of said first frame member adjacent one of said lips, and wherein said apparatus is configured to pivot on said second edge between said first position and a second position, wherein in said second position said first wall of said first frame is disengaged from said first wall of said second frame.

14. The apparatus of claim 12 wherein said lips are perpendicular to said first wall of said first frame member, and are configured to be graspable by a user when said apparatus is in said first position.

15. The apparatus of claim 12 wherein a distance between the two lips is greater than a distance between said second and third wall of said second frame member.

16. The apparatus of claim 12, said first and second frame members are hingeless.

17. The apparatus of claim 12, said at least one latch does not move independently of said first and second frame members.

18. The apparatus of claim 12, said first and second frame members move together to form said enclosure when said first and second frame members are substantially aligned.

19. The apparatus of claim 12, said at least one latch is not visible when said first and second frame members form said enclosure.

* * * * *